US007408437B2

(12) United States Patent
Ueki et al.

(10) Patent No.: US 7,408,437 B2
(45) Date of Patent: Aug. 5, 2008

(54) RESISTANCE ELEMENT, ITS PRECURSOR, AND RESISTANCE VALUE ADJUSTING METHOD

(75) Inventors: Masatoshi Ueki, Niwa-gun (JP); Hitoshi Yokoi, Ama-gun (JP)

(73) Assignee: NGK Spark Plug Co., Ltd., Aichi (JP)

( * ) Notice: Subject to any disclaimer, the term of this patent is extended or adjusted under 35 U.S.C. 154(b) by 51 days.

(21) Appl. No.: 11/597,048

(22) PCT Filed: May 12, 2005

(86) PCT No.: PCT/JP2005/008693

§ 371 (c)(1),
(2), (4) Date: Dec. 11, 2006

(87) PCT Pub. No.: WO2005/112052

PCT Pub. Date: Nov. 24, 2005

(65) Prior Publication Data

US 2008/0048823 A1 Feb. 28, 2008

(30) Foreign Application Priority Data

May 18, 2004 (JP) ..... 2004-147812

(51) Int. Cl.
*H01C 10/00* (2006.01)

(52) U.S. Cl. ..... 338/195; 338/287; 338/292

(58) Field of Classification Search ..... 338/195, 338/282–287, 292–295; 29/610.1, 620
See application file for complete search history.

(56) References Cited

U.S. PATENT DOCUMENTS

| | | | | |
|---|---|---|---|---|
| 5,394,019 | A * | 2/1995 | Audy | 327/525 |
| 5,754,092 | A * | 5/1998 | Ishida et al. | 338/195 |
| 6,184,775 | B1 * | 2/2001 | Gerber et al. | 338/195 |
| 6,292,091 | B1 * | 9/2001 | Kambara et al. | 338/195 |
| 6,452,478 | B1 * | 9/2002 | Dale | 338/195 |
| 6,480,092 | B1 * | 11/2002 | Hoshii et al. | 338/195 |

FOREIGN PATENT DOCUMENTS

| | | | |
|---|---|---|---|
| EP | 0 001 520 | A1 | 4/1979 |
| JP | 54-61661 | A | 5/1979 |
| JP | 56110203 | A | 9/1981 |
| JP | 5763852 | A | 4/1982 |

* cited by examiner

*Primary Examiner*—K. Richard Lee
(74) *Attorney, Agent, or Firm*—Sughrue Mion, PLLC

(57) ABSTRACT

An object of the invention is to provide a resistor element that makes it possible to adjust the resistance value of a precursor easily in producing a resistance element having a target resistance value from the precursor, as well as to the precursor and a related resistance value adjusting method.

A precursor 70 has a meandering resistance pattern formed on a front surface 11 of a substrate 10 as well as at least three trimming lines. The precursor 70 is configured so as to be defined by a geometric sequence that satisfies Inequality $0.5\alpha_k<\alpha_{k+1}<\alpha_k$, where $\alpha_k$ is the general term of the sequence that is obtained by arranging, in descending order, resistance value increases of the precursor at the time of cutting of the respective trimming lines and normalizing the thus-arranged resistance value increases by an initial resistance value of the precursor in a state that none of the trimming lines are cut.

3 Claims, 13 Drawing Sheets

| α k | RESISTANCE VARIATION RATIO AT THE TIME OF CUTTING OF TRIMMING PORTION | | |
|---|---|---|---|
| | EXAMPLE | COMPARATIVE EXAMPLE 1 | COMPARATIVE EXAMPLE 2 |
| α 1 | 0. 207 | 0. 250 | 0. 250 |
| α 2 | 0. 121 | 0. 125 | 0. 125 |
| α 3 | 0. 071 | 0. 062 | 0. 062 |
| α 4 | 0. 042 | 0. 031 | 0. 031 |
| α 5 | 0. 024 | 0. 016 | 0. 016 |
| α 6 | 0. 014 | 0. 008 | 0. 008 |
| α 7 | 0. 008 | 0. 004 | 0. 004 |
| α 8 | 0. 005 | 0. 002 | 0. 002 |
| α 9 | 0. 003 | | |
| α 10 | 0. 002 | | |
| TOTAL | 0. 498 | 0. 498 | 0. 498 |
| NUMBER OF THRESHOLD VALUES | 10 | 255 | 8 |

| α k | RESISTANCE VARIATION RATIO AT THE TIME OF CUTTING OF TRIMMING PORTION |
|---|---|
| | EXAMPLE |
| α 1 | 0. 225 |
| α 2 | 0. 118 |
| α 3 | 0. 066 |
| α 4 | 0. 038 |
| α 5 | 0. 022 |
| α 6 | 0. 013 |
| α 7 | 0. 008 |
| α 8 | 0. 005 |
| α 9 | 0. 003 |
| α 10 | 0. 002 |
| TOTAL | 0. 498 |
| NUMBER OF THRESHOLD VALUES | 10 |

FIG. 20

| | | RESISTANCE VARIATION RATIO AT THE TIME OF CUTTING OF TRIMMING PORTION | | | | | | | | | |
|---|---|---|---|---|---|---|---|---|---|---|---|
| | k | 1 | 2 | 3 | 4 | 5 | 6 | 7 | 8 | 9 | 10 |
| EXAMPLE 1 | $\alpha k$ | 0.207 | 0.121 | 0.071 | 0.042 | 0.024 | 0.014 | 0.008 | 0.005 | 0.003 | 0.002 |
| EXAMPLE 2 | $\alpha k$ | 0.225 | 0.118 | 0.066 | 0.038 | 0.022 | 0.013 | 0.008 | 0.005 | 0.003 | 0.002 |
| EXAMPLE 3 | $\alpha k$ | 0.207 | 0.121 | 0.071 | 0.042 | 0.024 | 0.014 | 0.008 | 0.005 | — | — |
| | $\sigma k$ | 0.00070 | 0.00045 | 0.00031 | 0.00021 | 0.00014 | 0.00009 | 0.00006 | 0.00004 | — | — |
| | $\alpha k+3\sigma k$ | 0.209 | 0.123 | 0.072 | 0.042 | 0.025 | 0.015 | 0.009 | 0.005 | — | — |
| | $\alpha k-3\sigma k$ | 0.205 | 0.120 | 0.070 | 0.041 | 0.024 | 0.014 | 0.008 | 0.005 | — | — |
| EXAMPLE 4 | $\alpha k$ | 0.225 | 0.118 | 0.066 | 0.038 | 0.022 | 0.013 | 0.008 | 0.005 | — | — |
| | $\sigma k$ | 0.00075 | 0.00044 | 0.00029 | 0.00019 | 0.00012 | 0.00008 | 0.00006 | 0.00004 | — | — |
| | $\alpha k+3\sigma k$ | 0.227 | 0.119 | 0.066 | 0.038 | 0.022 | 0.013 | 0.008 | 0.005 | — | — |
| | $\alpha k-3\sigma k$ | 0.222 | 0.116 | 0.065 | 0.037 | 0.022 | 0.013 | 0.008 | 0.005 | — | — |
| EXAMPLE 5 | $\alpha k$ | 0.225 | 0.118 | 0.066 | 0.038 | 0.022 | 0.013 | 0.008 | 0.005 | 0.003 | 0.002 |
| | $\sigma k$ | 0.00075 | 0.00044 | 0.00029 | 0.00019 | 0.00012 | 0.00008 | 0.00006 | 0.00004 | 0.00003 | 0.00002 |
| | $\alpha k+3\sigma k$ | 0.227 | 0.119 | 0.066 | 0.038 | 0.022 | 0.013 | 0.008 | 0.005 | 0.003 | 0.002 |
| | $\alpha k-3\sigma k$ | 0.222 | 0.116 | 0.065 | 0.037 | 0.022 | 0.013 | 0.008 | 0.005 | 0.003 | 0.002 |
| COMPARATIVE EXAMPLE 1 | $\alpha k$ | 0.250 | 0.125 | 0.062 | 0.031 | 0.016 | 0.008 | 0.004 | 0.002 | — | — |
| COMPARATIVE EXAMPLE 2 | $\alpha k$ | 0.250 | 0.125 | 0.062 | 0.031 | 0.016 | 0.008 | 0.004 | 0.002 | — | — |
| COMPARATIVE EXAMPLE 3 | $\alpha k$ | 0.250 | 0.125 | 0.062 | 0.031 | 0.016 | 0.008 | 0.004 | 0.002 | — | — |
| | $\sigma k$ | 0.00083 | 0.00046 | 0.00028 | 0.00016 | 0.00009 | 0.00005 | 0.00003 | 0.00002 | — | — |
| | $\alpha k+3\sigma k$ | 0.252 | 0.126 | 0.063 | 0.032 | 0.016 | 0.008 | 0.004 | 0.002 | — | — |
| | $\alpha k-3\sigma k$ | 0.247 | 0.123 | 0.062 | 0.031 | 0.015 | 0.008 | 0.004 | 0.002 | — | — |
| COMPARATIVE EXAMPLE 4 | $\alpha k$ | 0.250 | 0.125 | 0.062 | 0.031 | 0.016 | 0.008 | 0.004 | 0.002 | — | — |
| | $\sigma k$ | 0.00083 | 0.00046 | 0.00028 | 0.00016 | 0.00009 | 0.00005 | 0.00003 | 0.00002 | — | — |
| | $\alpha k+3\sigma k$ | 0.252 | 0.126 | 0.063 | 0.032 | 0.016 | 0.008 | 0.004 | 0.002 | — | — |
| | $\alpha k-3\sigma k$ | 0.247 | 0.123 | 0.062 | 0.031 | 0.015 | 0.008 | 0.004 | 0.002 | — | — |

RESISTANCE ELEMENT, ITS PRECURSOR, AND RESISTANCE VALUE ADJUSTING METHOD

TECHNICAL FIELD

The present invention relates to a resistance element, its precursor, and a resistance value adjusting method.

BACKGROUND ART

As disclosed in the following Patent document 1, for example, a precursor of a resistance element is known that is applied to a thin-film temperature sensor. This precursor of a resistance element which is applied to a thin-film temperature sensor is produced by evaporating a platinum film on an alumina substrate by sputtering and patterning the platinum film into a prescribed pattern by photolithography.

Patent document 1: Japanese Utility Model Application Laid-Open No. Sho 63-187303

DISCLOSURE OF THE INVENTION

Problems to be Solved by the Invention

Incidentally, in the precursor of a resistance element which is produced in the above-described manner, the prescribed pattern is formed in such a manner that plural resistance adjustment patterns whose resistance values are weighted so as to have relative values $2^0$, $2^1$, $2^2$, $2^3$, . . . are arranged in order. To produce a resistance element having a target resistance value from this precursor, it is necessary to trim the resistance adjustment patterns of the precursor.

However, since as described above the plural resistance adjustment patterns are arranged in such a manner that their resistance values are weighted so as to have such relative values as to provide $2^n$ resistance values, in determining trimming portions to be trimmed of the precursor, the number of combinations of trimming portions and an initial resistance value, that is, a pre-trimming resistance value of the precursor, amounts to an enormous number of $2^n$.

Therefore, in the above precursor, trimming portions to be trimmed need to be determined by using such an enormous number of combinations of trimming portions and an initial resistance value. This results in a problem that much time and labor are needed to generate data to be used for determining trimming portions and input the generated data.

To solve the above problems, an object of the present invention is to provide a resistor element that makes it possible to adjust the resistance value of a precursor easily in producing a resistance element having a target resistance value from the precursor, as well as to the precursor and a related resistance value adjusting method.

Means for Solving the Problems

To solve the above problems, a precursor according the aspect of the invention recited in claim 1 has a resistance pattern (71) which is formed on a substrate (10) with a resistance material in meandering form and short-circuiting portions (74-79) which are formed so as to short-circuit plural pairs of longitudinal intermediate portions of the resistance pattern, respectively.

In this precursor, the plural pairs of longitudinal intermediate portions are at least three pairs of longitudinal intermediate portions.

In a normalized resistance value increase sequence obtained by arranging, in descending order, resistance value increases at the time of cutting of the respective short-circuiting portions and normalizing the resistance value increases by a resistance value obtained in a state that none of the short-circuiting portions are cut, a smaller one of each adjoining pair of normalized resistance value increases of the normalized resistance value increase sequence is larger than ½ of a larger one.

A normalized resistance value increase ratio of a larger one of each adjoining pair of normalized resistance value increases of the normalized resistance value increase sequence to a smaller one is a constant value.

Producing a precursor in the above-described manner makes it possible to provide a precursor for a resistance element whose resistance value can easily be adjusted to a target resistance value.

In the precursor according to the aspect of the invention recited in claim 1, the normalized resistance value increase sequence is a sequence having terms $\alpha_k$'s (k=1, 2, 3, . . . ) and satisfies $0.5\alpha_k<\alpha_{k+1}<\alpha_k$.

This sequence may be a geometric sequence whose common ratio is the above constant normalized resistance value increase ratio.

A precursor according the aspect of the invention recited in claim 2 has a resistance pattern (71) which is formed on a substrate (10) with a resistance material in meandering form and short-circuiting portions (74-79) which are formed so as to short-circuit plural pairs of longitudinal intermediate portions of the resistance pattern, respectively.

In this precursor, a normalized resistance value increase sequence obtained by arranging, in descending order, resistance value increases at the time of cutting of the respective short-circuiting portions and normalizing the resistance value increases by a resistance value obtained in a state that none of the short-circuiting portions are cut is a sequence which has terms $\alpha_k$'s (k=1, 2, 3, . . . ) and satisfies $(1+\alpha_1+\alpha_2+\ldots+\alpha_k)(1+\alpha_k)=(1+\alpha_1)^2$.

As in the case of the aspect of the invention recited in claim 1, producing a precursor in the above-described manner makes it possible to provide a precursor for a resistance element whose resistance value can easily be adjusted to a target resistance value.

In a precursor resistance value adjusting method according to the aspect of the invention recited in claim 3, a precursor having a resistance pattern (71) which is formed on a substrate (10) with a resistance material in meandering form and short-circuiting portions (74-79) which are formed so as to short-circuit plural pairs of longitudinal intermediate portions of the resistance pattern, respectively, is prepared and a resistance value of the precursor is adjusted to a target resistance value by selectively cutting the short-circuiting portions.

In this precursor resistance value adjusting method, the precursor is prepared as a precursor (70) in which the plural pairs of longitudinal intermediate portions are at least three pairs of longitudinal intermediate portions, and a normalized resistance value increase sequence obtained by arranging, in descending order, resistance value increases at the time of cutting of the respective short-circuiting portions and normalizing the resistance value increases by a resistance value obtained in a state that none of the short-circuiting portions are cut is defined as a geometric sequence which has terms $\alpha_k$'s (k=1, 2, 3, . . . ) and satisfies $0.5\alpha_k<\alpha_{k+1}<\alpha_k$.

The resistance value of the precursor is adjusted to the target resistance value by repeating, in descending order of the cutting-induced resistance value increases of the short-circuiting portions of the thus-prepared precursor, processing of:

a first step (230) of judging whether a resistance value of the precursor before cutting of the short-circuiting portion is smaller than a threshold value for the short-circuiting portion;

a second step (234) of determining that the short-circuiting portion should be cut, if the first step judges that the resistance value of the precursor before cutting of the short-circuiting portion is smaller than the threshold value for the short-circuiting portion; and a step of judging, at the first step, skipping the second step, whether the resistance value of the precursor is smaller than a threshold value for a next short-circuiting portion whose cutting-induced resistance value increase is largest next to the cutting-induced resistance value increase of the current short-circuiting portion, if the first step judges that the resistance value of the precursor before cutting of the short-circuiting portion is larger than or equal to the threshold value for the short-circuiting portion;

while cutting the short-circuiting portion every time the second step judges that the short-circuiting portion should be cut, as the processing is repeated.

As described above, the resistance value of the precursor is adjusted to the target resistance value by repeatedly executing, on the thus-prepared precursor, the first step and the second step or the first step and again the first step (the second step if skipped) of judging whether the resistance value of the precursor is smaller than a threshold value for a next short-circuiting portion whose cutting-induced resistance value increase is largest next to the cutting-induced resistance value increase of the current short-circuiting portion, while cutting the short-circuiting portion every time the second step judges that the short-circuiting portion should be cut, as the above processing is repeated.

As a result, unlike in the conventional case, the resistance value of the precursor can easily be adjusted to the target resistance value without the need for an enormous amount of data for cutting of the short-circuiting portions.

In a precursor resistance value adjusting method according to the aspect of the invention recited in claim 4, a precursor having a resistance pattern (71) which is formed on a substrate (10) with a resistance material in meandering form and short-circuiting portions (74-79) which are formed so as to short-circuit plural pairs of longitudinal intermediate portions of the resistance pattern, respectively, is prepared and a resistance value of the precursor is adjusted to a target resistance value by selectively cutting the short-circuiting portions.

In this precursor resistance value adjusting method, the precursor is prepared as a precursor in which a normalized resistance value increase sequence obtained by arranging, in descending order, resistance value increases at the time of cutting of the respective short-circuiting portions and normalizing the resistance value increases by a resistance value obtained in a state that none of the short-circuiting portions are cut is defined as a sequence which has terms $\alpha_k$'s (k=1, 2, 3, . . . ) and satisfies $(1+\alpha_1+\alpha_2+\ldots+\alpha_k)(1+\alpha_k)=(1+\alpha_1)^2$.

The resistance value of the precursor is adjusted to the target resistance value by repeating, in descending order of the cutting-induced resistance value increases of the short-circuiting portions of the thus-prepared precursor, processing of:

a first step (230) of judging whether a resistance value of the precursor before cutting of the short-circuiting portion is smaller than a threshold value for the short-circuiting portion;

a second step (234) of determining that the short-circuiting portion should be cut, if the first step judges that the resistance value of the precursor before cutting of the short-circuiting portion is smaller than the threshold value for the short-circuiting portion; and a step of judging, at the first step, skipping the second step, whether the resistance value of the precursor is smaller than a threshold value for a next short-circuiting portion whose cutting-induced resistance value increase is largest next to the cutting-induced resistance value increase of the current short-circuiting portion, if the first step judges that the resistance value of the precursor before cutting of the short-circuiting portion is larger than or equal to the threshold value for the short-circuiting portion;

while cutting the short-circuiting portion every time the second step judges that the short-circuiting portion should be cut, as the processing is repeated.

As described above, as in the case of the aspect of the invention recited in claim 3, the resistance value of the precursor is adjusted to the target resistance value by repeatedly executing, on the thus-prepared precursor, the first step and the second step or the first step and again the first step (the second step if skipped) of judging whether the resistance value of the precursor is smaller than a threshold value for a next short-circuiting portion whose cutting-induced resistance value increase is largest next to the cutting-induced resistance value increase of the current short-circuiting portion, while cutting the short-circuiting portion every time the second step judges that the short-circuiting portion should be cut, as the above processing is repeated.

As a result, unlike in the conventional case, even with the precursor of the aspect of the invention recited in claim 4 which is different from the precursor of the aspect of the invention recited in claim 3, the resistance value of the precursor can easily be adjusted to the target resistance value without the need for an enormous amount of data for cutting of the short-circuiting portions.

A resistance element according to the aspect of the invention recited in claim 5 is produced from a precursor by preparing a precursor having a resistance pattern (71) which is formed on a substrate (10) with a resistance material in meandering form and short-circuiting portions (74-79) which are formed so as to short-circuit plural pairs of longitudinal intermediate portions of the resistance pattern, respectively, and adjusting a resistance value of the precursor to a target resistance value by selectively cutting the short-circuiting portions.

In this resistance element, the precursor is a precursor (70) in which the plural pairs of longitudinal intermediate portions are at least three pairs of longitudinal intermediate portions, and a normalized resistance value increase sequence obtained by arranging, in descending order, resistance value increases at the time of cutting of the respective short-circuiting portions and normalizing the resistance value increases by a resistance value obtained in a state that none of the short-circuiting portions are cut is defined as a geometric sequence which has terms $\alpha_k$'s (k=1, 2, 3, . . . ) and satisfies $0.5\alpha_k<\alpha_{k+1}<\alpha_k$.

The resistance element is produced from the precursor by adjusting the resistance value of the precursor to the target resistance value by repeating, in descending order of the cutting-induced resistance value increases of the short-circuiting portions of the precursor, processing of cutting the short-circuiting portion if the resistance value of the precursor before cutting of the short-circuiting portion is smaller than a threshold value for the short-circuiting portion, leaving the short-circuiting portion uncut if the resistance value of the precursor before cutting of the short-circuiting portion is larger than or equal to the threshold value for the short-circuiting portion, and, with the current short-circuiting portion left uncut, cutting a next short-circuiting portion whose cutting-induced resistance value increase is largest next to the cutting-induced resistance value of the current short-circuiting portion if the resistance value of the precursor before cutting of the next short-circuiting portion is smaller than a threshold value for the next short-circuiting portion or leaving the next short-circuiting portion uncut if the resistance value of the precursor before cutting of the next short-circuiting portion is larger than or equal to the threshold value for the next short-circuiting portion.

Producing a resistance element in the above-described manner makes it possible to easily provide a resistance element which is produced from, for example, the precursor described in the aspect of the invention recited in claim 3.

A resistance element according to the aspect of the invention recited in claim 6 is produced from a precursor by preparing a precursor having a resistance pattern (71) which is formed on a substrate (10) with a resistance material in meandering form and short-circuiting portions (74-79) which are formed so as to short-circuit plural pairs of longitudinal intermediate portions of the resistance pattern, respectively, and adjusting a resistance value of the precursor to a target resistance value by selectively cutting the short-circuiting portions.

The precursor is a precursor (70) in which a normalized resistance value increase sequence obtained by arranging, in descending order, resistance value increases at the time of cutting of the respective short-circuiting portions and normalizing the resistance value increases by a resistance value obtained in a state that none of the short-circuiting portions are cut is defined as a sequence which has terms $\alpha_k$'s (k=1, 2, 3, . . . ) and satisfies $(1+\alpha_1+\alpha_2+\ldots+\alpha_k)(1+\alpha_k)=(1+\alpha_1)^2$.

The resistance element is produced from the precursor by adjusting the resistance value of the precursor to the target resistance value by repeating, in descending order of the cutting-induced resistance value increases of the short-circuiting portions of the precursor, processing of cutting the short-circuiting portion if the resistance value of the precursor before cutting of the short-circuiting portion is smaller than a threshold value for the short-circuiting portion, leaving the short-circuiting portion uncut if the resistance value of the precursor before cutting of the short-circuiting portion is larger than or equal to the threshold value for the short-circuiting portion, and, with the current short-circuiting portion left uncut, cutting a next short-circuiting portion whose cutting-induced resistance value increase is largest next to the cutting-induced resistance value of the current short-circuiting portion if the resistance value of the precursor before cutting of the next short-circuiting portion is smaller than a threshold value for the next short-circuiting portion or leaving the next short-circuiting portion uncut if the resistance value of the precursor before cutting of the next short-circuiting portion is larger than or equal to the threshold value for the next short-circuiting portion.

Producing a resistance element in the above-described manner makes it possible to easily provide a resistance element which is produced from, for example, the precursor described in the aspect of the invention recited in claim 4.

The parenthesized symbols for the above respective means indicate corresponding relationships with specific means in the embodiments described later.

BRIEF DESCRIPTION OF THE DRAWINGS

FIG. 20 is a table showing a resistance variation ratio(s) at the time of cutting of a trimming portion for $\alpha_k$ (k=1 to 10) or for $\alpha_k$ and $\alpha_k \pm 3\sigma_k$ in Examples 1-5 of and Comparative Examples 1-4 for the third embodiment of the invention

DESCRIPTION OF SYMBOLS

10 . . . Substrate; 70 . . . Precursor; 71 . . . Resistance patterns; 74-79 . . . Trimming lines; 102 . . . Computer.

BEST MODE FOR CARRYING OUT THE INVENTION

First Embodiment

Figure 1:
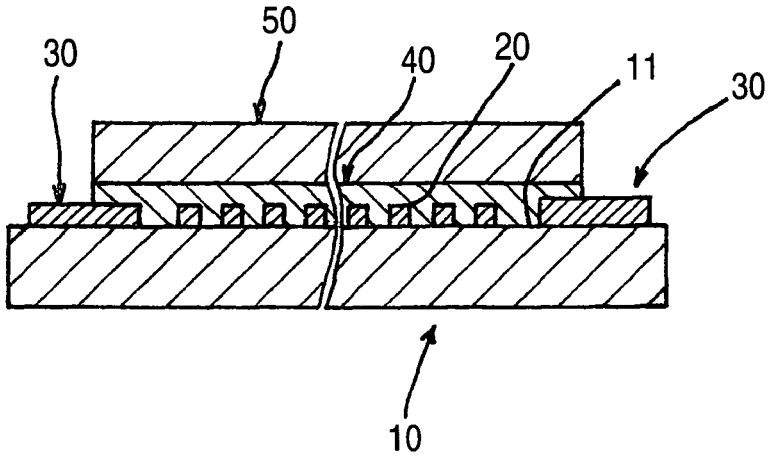
FIG. 1 is a sectional view of a first embodiment to which the present invention is applied.

FIG. 1 shows an example in which the present invention is applied to a platinum-resistor-type temperature sensor. This temperature sensor is equipped with a substrate 10 which is made of a material having high-purity alumina ($Al_2O_3$) as the main component (hereinafter also referred to as "high-purity alumina material"). In this embodiment, a material containing alumina by 99.9% or more is employed as the high-purity alumina material.

This temperature sensor is equipped with a meandering platinum resistor 20 and two connection pads 30. The platinum resistor 20 is formed on a central portion of a front surface 11 of the substrate 10 by a method described below. The two pads 30 are formed on the front surface 11 of the substrate 10 on both sides of the platinum resistor 20 so as to be integral with the platinum resistor 20.

This temperature sensor is also equipped with a bonding layer 40 and a protective layer 50. The bonding layer 40 is bonded to the front surface 11 of the substrate 10 so as to cover the platinum resistor 20 and the two pads 30. The protective layer 50 is laid on the bonding layer 40 to form a layered structure together.

Figure 2:
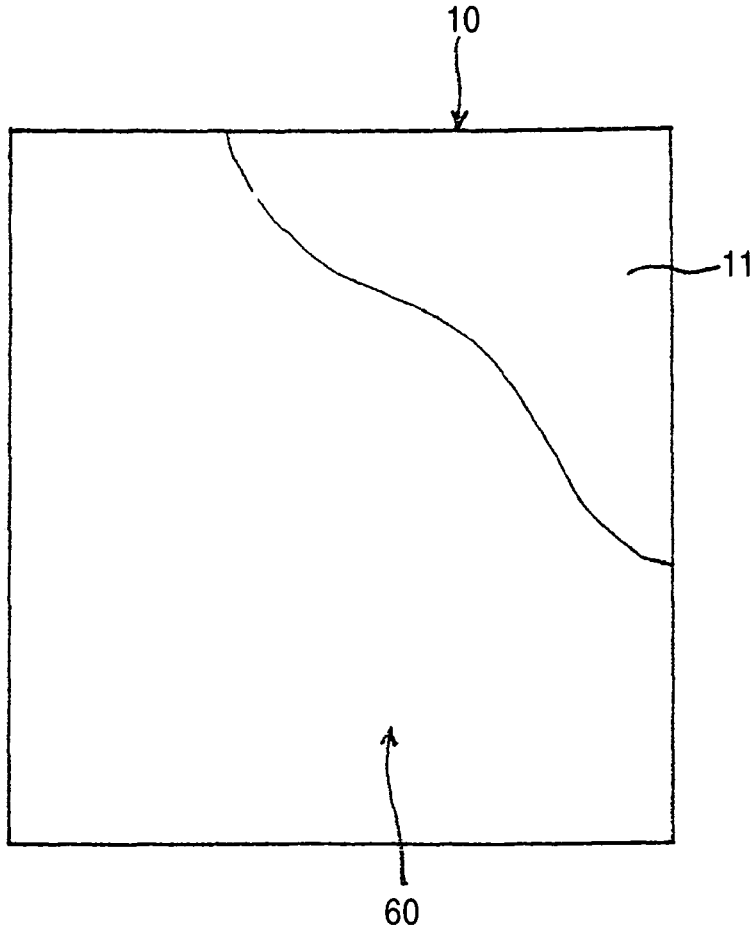
FIG. 2 is a partially cutaway plan view showing part of a manufacturing process of a temperature sensor of FIG. 1.

Next, a manufacturing method of the temperature sensor having the above configuration will be described. First, a substrate made of the above-mentioned high-purity alumina material is prepared as a substrate 10 (see FIG. 2). Then, as shown in FIG. 2, a platinum film 60 is formed on a front surface 11 of the substrate 10 by sputtering platinum (Pt).

Figure 3:
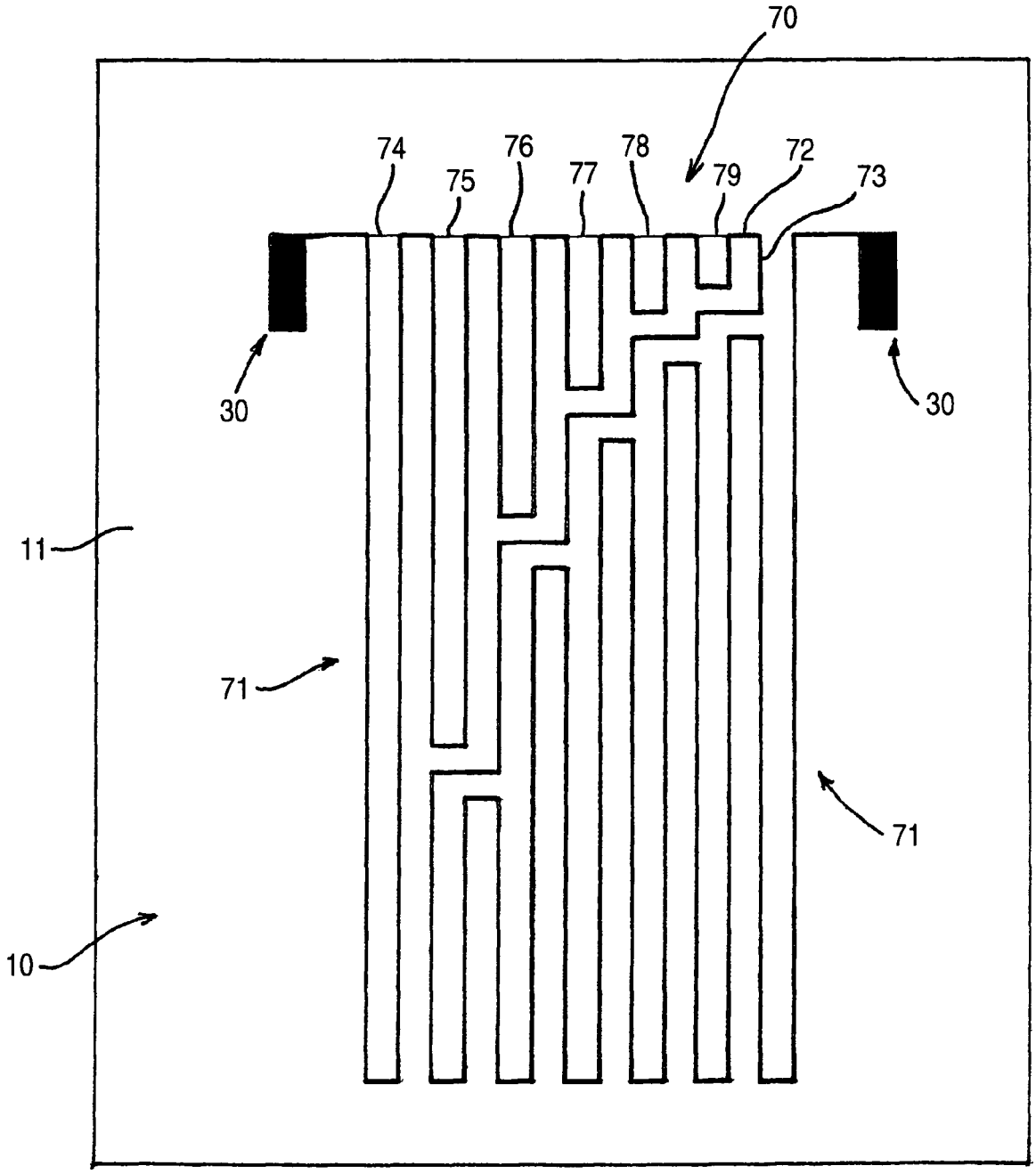
FIG. 3 is a plan view of a precursor which is used for producing a resistance element of the temperature sensor of FIG. 1.

Then, a precursor 70 and two pads 30 are formed on the front surface 11 of the substrate 10 by patterning the platinum film 60 by photolithography (see FIG. 3). The precursor 70, from which a platinum resistor 20 is to be produced, is formed between the two pads 30 in a shape shown in FIG. 3 by the above-mentioned patterning.

The structure of the precursor 70 will be described here in detail. As shown in FIG. 3, the precursor 70 has two meandering resistance patterns 71. The two resistance patterns 71 are formed on the front surface 11 of the substrate 10 between the two pads 30 so as to meander (i.e., reciprocate) in the vertical direction and to occupy a top-left region and a bottom-right region as viewed in FIG. 3. Of the two resistance patterns 71, the top-left resistance pattern 71 will also be called a first resistance pattern 71 and the bottom-right resistance pattern will also be called a second resistance pattern 71.

As shown in FIG. 3, a left-hand horizontal top end portion (as viewed in FIG. 3) of the first resistance pattern 71 is integral with the left-hand pad 30. On the other hand, as shown in FIG. 3, a right-hand horizontal top end portion (as viewed in FIG. 3) of the second resistance pattern 71 is integral with the right-hand pad 30. As shown in FIG. 3, a right-hand horizontal top end portion 72 (as viewed in FIG. 3) of the first resistance pattern 71 is integral with a right-hand vertical top end portion 73 (as viewed in FIG. 3) of the second resistance pattern 71.

As shown in FIG. 3, the precursor 70 has six trimming lines 74-79, which are used for adjusting the resistance between the two end portions (connected to the respective pads 30) of the precursor 70 depending on whether they are cut or not.

Between the left-hand horizontal top end portion and the right-hand horizontal top end portion 72 of the first resistance pattern 71, the trimming lines 74-79 form a horizontal straight line with five top horizontal intermediate portions of the first resistance pattern 71 and are integral with the latter. The five top horizontal intermediate portions are called first, second, third, fourth, and fifth top horizontal intermediate portions from left to right in FIG. 3.

The trimming line 74 is connected to the left-hand horizontal top end portion of the first resistance pattern 71 and the first top horizontal intermediate portion. The trimming line 75 is connected to the first and second top horizontal intermediate portions. The trimming line 76 is connected to the second and third top horizontal intermediate portions. The trimming line 77 is connected to the third and fourth top horizontal intermediate portions. The trimming line 78 is connected to the fourth and fifth top horizontal intermediate portions. The trimming line 79 is connected to the fifth top horizontal intermediate portion and the right-hand horizontal top end portion 72 of the first resistance pattern 71.

In the first embodiment, in general, conditions (hereinafter also referred to as "precursor conditions") that the precursor of the resistance element 20 should satisfy are set as follows:

(1) The precursor has a meandering resistance pattern which is formed on the front surface 11 of the substrate 10.

(2) The precursor has at least three trimming lines.

(3) Inequality $$0.5\alpha_k < \alpha_{k+1} < \alpha_k \quad (1)$$

holds where $\alpha_k$ is the general term of a sequence of resistance value increases of the precursor at the time of cutting of the respective trimming lines, the resistance value increases being arranged in descending order and normalized by an initial resistance value of the precursor (i.e., its resistance value in a state that none of the trimming lines are cut).

(4) The above sequence is a geometric sequence whose common ratio is greater than 0.5 and smaller than 1.0 as is understood from Inequality (1).

The precursor 70 which is produced in the above manner by patterning satisfies the precursor conditions (1) and (2) because it has the two resistance patterns and six trimming lines which are shaped as shown in FIG. 3.

It is assumed that the resistance patterns satisfy the precursor conditions (3) and (4). That is, it is assumed that Inequality (1) holds for a geometric sequence (general term $\alpha_k$; k=1, 2, . . . , 6) of resistance value increases of the precursor 70 at the time of cutting of the respective trimming lines 74-79, the resistance value increases being arranged in descending order and normalized by an initial resistance value of the precursor 70 (i.e., its resistance value in a state that none of the trimming lines 74-79 are cut), and that the common ratio of the geometric sequence is greater than 0.5 and smaller than 1.0.

Next, a description will be made of a resistance value adjusting method for adjusting the resistance value of the precursor 70 to a target resistance value (i.e., the resistance value of the platinum resistor 20) by trimming the precursor 70, in the substrate 10 on which the precursor 70 is formed in the above-described manner. The target resistance value will be hereinafter represented by Ra.

Before the description of the resistance value adjusting method, the configuration of a trimming apparatus which is necessary for trimming the precursor 70 will be described with reference to FIG. 4. This trimming apparatus is equipped with a movable stage 80 and a YAG laser 90. The movable stage 80 is supported so as to be movable in an X-axis direction (right-left direction in FIG. 4) and a Y-axis direction (paper depth direction in FIG. 4) in a horizontal plane (XY-coordinate plane) in FIG. 4. The above-described substrate 10 is placed on and fixed to the movable stage 80 with the precursor 70 up.

The YAG laser 90 is disposed above the movable stage 80 and is supported so as to be movable in the X-axis direction and the Y-axis direction like the movable stage 80. The YAG laser 90 emits a laser beam from its beam outlet toward the movable stage 80.

Figure 4:
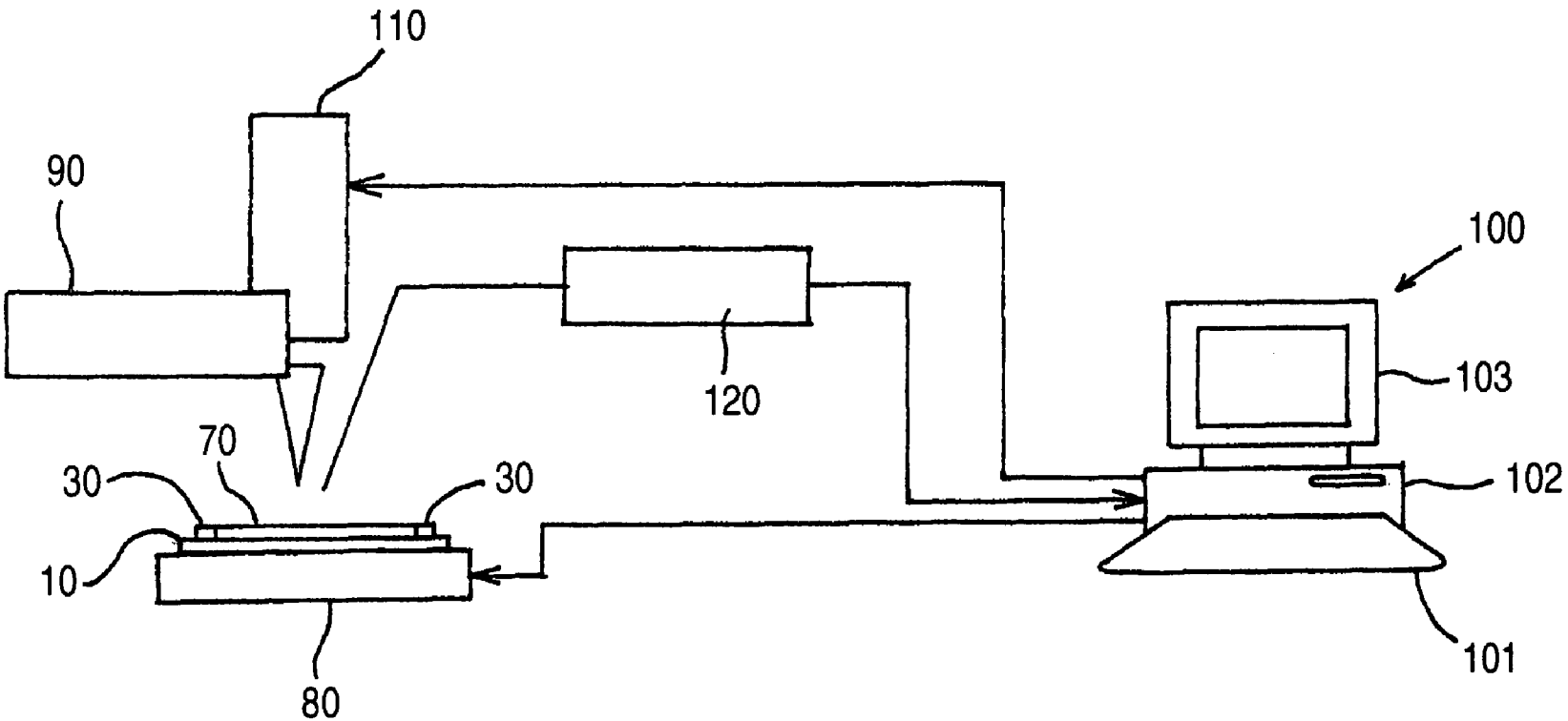
FIG. 4 is a block diagram of a trimming apparatus for trimming the precursor of FIG. 3 which is formed on a substrate.

As shown in FIG. 4, the trimming apparatus is also equipped with a terminal 100, a controller 110, and a resistance meter 120. The terminal 100 is composed of input devices 101 such as a keyboard and a mouse, a computer 102, and a monitor 103. The input devices 101 input necessary data to the computer 102 in response to input manipulations performed thereon.

Figure 5:
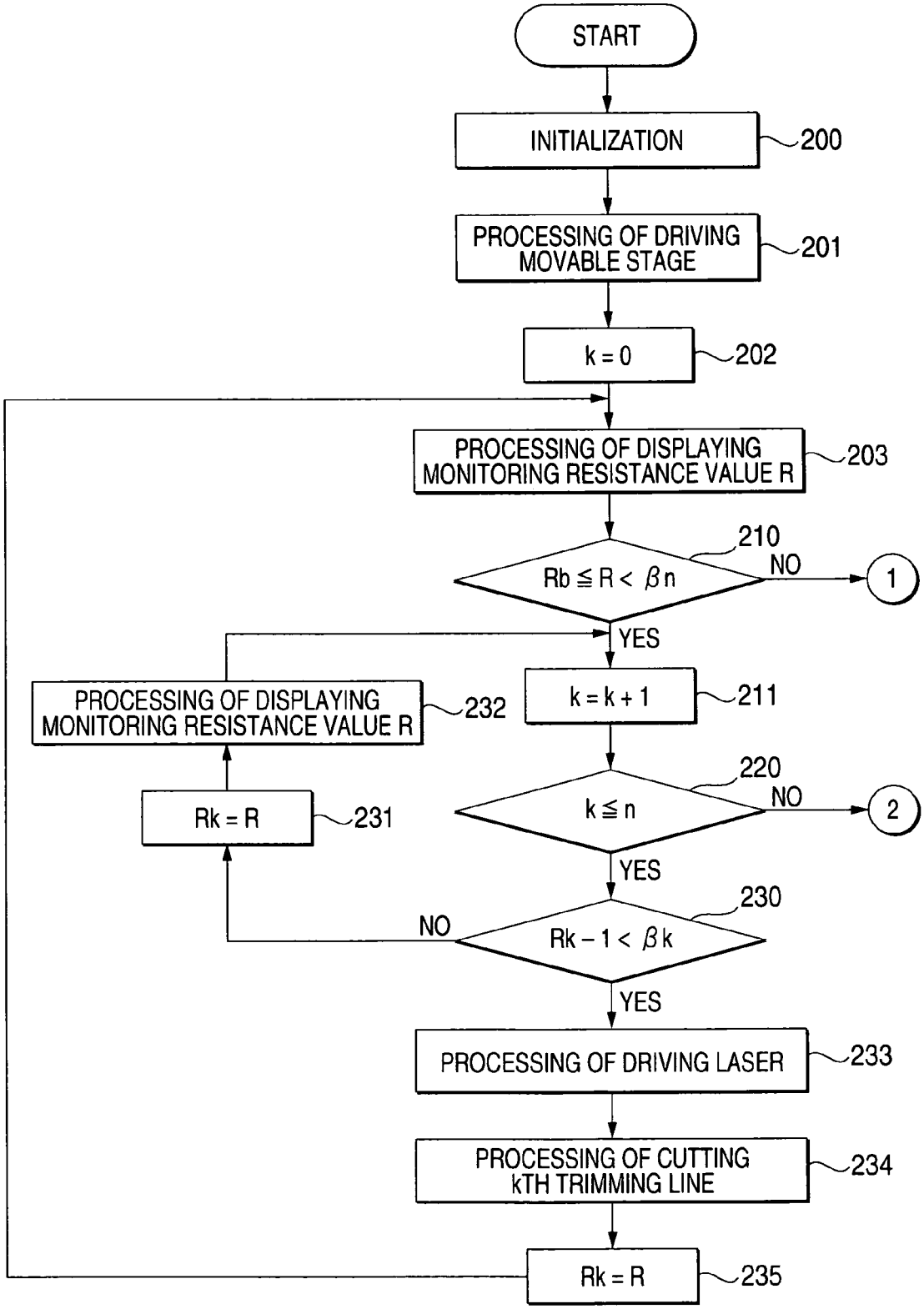
FIG. 5 is part of a flowchart showing the workings of a computer shown in FIG. 4.
Figure 6:
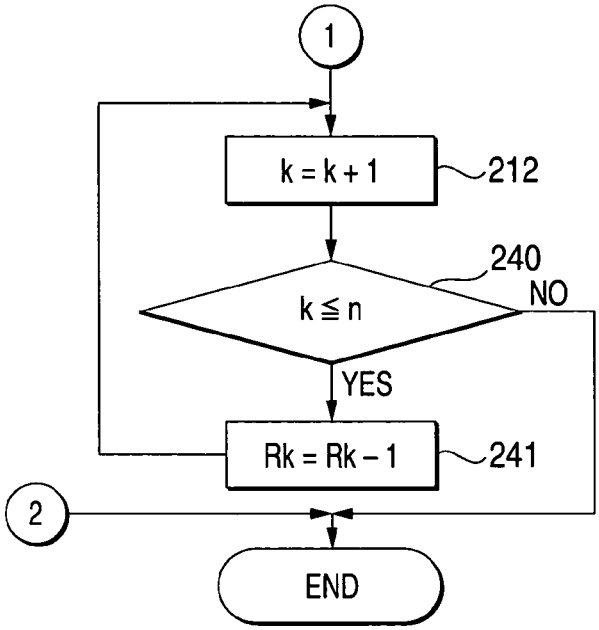
FIG. 6 is the remaining part of the flowchart showing the workings of the computer shown in FIG. 4.

The computer 102 runs a computer program which is based on a flowchart shown in FIGS. 5 and 6. During that course, the computer 102 performs processing necessary for the control of the movement position of the movable stage 80, the control of the controller 110, the display of the monitor 103, etc. on the basis of input data from the input devices 101, a measured resistance value of the resistance meter 120, and other data. The computer program is stored in a ROM of the computer 102 in advance.

The monitor 103, which is a display device, displays data that are supplied from the computer 102 under the control of the computer 102. Controlled by the computer 102, the controller 110 drives the YAG laser 90 so as to move it in the X-axis direction or the Y-axis direction. The controller 110 also performs a laser beam emission control on the YAG laser 90 under the control of the computer 102. The resistance meter 120 measures a resistance between the two end portions of the precursor 70 and outputs it to the computer 102.

The resistance value adjusting method for adjusting the resistance value of the precursor 70 to a target resistance value Ra by trimming the precursor 70 using the above-configured trimming apparatus will be described below. As mentioned above, the substrate 10 is placed on and fixed to the movable stage 80 with the precursor 70 up.

If the trimming apparatus is rendered operational at this stage, the computer 102 starts running the computer program which is based on the flowchart of FIGS. 5 and 6. Upon the start of the computer program, at step 200 in FIG. 5, the computer 102 performs initialization processing, whereby threshold values $\beta_1, \beta_2, \ldots, \beta_n$ are input from the input devices 101 according to input manipulations performed thereon. In this embodiment, the suffix n of $\beta_n$ is 6 at the maximum because the six trimming lines exist. The threshold values $\beta_1, \beta_2, \ldots, \beta_n$ are judgment references for trimming processing on the respective trimming lines 74, 75, . . . , 79.

At step 201, drive processing is performed on the movable stage 80. In the drive processing, the movable stage 80 is driven so that the precursor 70 will be located right under the YAG laser 90. As a result, the movable stage 80 is moved so that the precursor will be located right under the YAG laser 90.

After the execution of step 201, at step 202 a variable k is cleared to 0. At step 203, processing of displaying a monitoring resistance value R is performed. In this display processing, a current resistance value of the precursor 70 is output from the computer 102 to the monitor 103 as a monitoring resistance value R on the basis of a measurement output of the resistance meter 120. In response, the monitor 103 displays, as the monitoring resistance value R, the current resistance value of the precursor 70.

After the performance of the display processing at step 203, it is judged at the next step 210 whether or not the monitoring resistance value R displayed at step 203 is greater than or equal to a pre-trimming lower limit resistance value Rb of the precursor 70 and smaller than the threshold value $\beta_n=\beta_6$. Since as described above the precursor 70 has the six trimming lines, it is assumed here that the threshold value for trimming processing on the sixth trimming line 79 is $\beta_n=\beta_6$ which is greater than any of the other threshold values $\beta_1$ to $\beta_5$.

If a relationship $Rb \leqq R < \beta_6$ is satisfied, a judgment result "yes" is produced at step 210. In this case, at the next step 211, "1" is added to the variable k to update it to 1; that is, k=k+1=1. At step 220, it is judged whether or not a relationship $k \leqq n$ is satisfied. Since the precursor 70 has the six trimming lines, the parameter n is equal to 6.

Since k=1 at this stage, the judgment result of step 220 should be "yes." Then, it is judged at step 230 whether or not a relationship $R_{k-1} < \beta_k$ is satisfied. Since k=1 at this stage, it is judged whether or not a relationship $R_{k-1}=R_0<\beta_1$ is satisfied. In this embodiment, $R_0$ represents a pre-trimming resistance value (i.e., initial resistance value) of the precursor 70 and $\beta_1$ represents the threshold value as the judgment reference for trimming processing on the trimming line 74.

If the relationship $R_{k-1}=R_0<\beta_1$ is not satisfied, a judgment result "no" is produced at step 230. This means that the trimming line 74 need not be cut, that is, it should be kept as it is. In this case, since k=1 at this stage, the variable $R_k=R_1$ is set to Rat step 231. The parameter $R_1$ represents a resistance value of the precursor 70 after completion of the trimming processing on the trimming line 74 (actually the trimming line 74 is not cut).

The resistance value $R_1$ is set to the monitoring resistance value R of the precursor 70 after the completion of the trimming processing on the trimming line 74 ($R_1$=R). After the execution of step 231, processing of displaying the monitoring resistance value R is performed at step 232. That is, the monitor 103 displays the monitoring resistance value $R=R_1$ which is supplied from the computer 102.

On the other hand, if the relationship $R_{k-1}=R_0<\beta_1$ is satisfied at step 230, a judgment result "yes" is produced. In this case, processing of driving the laser 90 is performed at step 233. As a result of the drive processing, the controller 110 performs a drive control so that the beam outlet of the laser 90 will be located right over the trimming line 74 of the precursor 70. As a result, the laser 90 is moved so that its beam outlet will be located right over the trimming line 74 of the precursor 70.

At the next step 234, processing of cutting the kth trimming line is performed. Since k=1 at this stage, this cutting processing is processing of cutting the trimming line 74. In this processing, the laser 90 emits a laser beam toward the trimming line 74 under the control of the controller 110. The trimming line 74 is thus cut.

After the execution of step 234, the variable $R_k=R_1$ is set to R at step 235 as is done at step 231. The parameter $R_1$ represents a resistance value of the precursor 70 after completion of the trimming processing on the trimming line 74 (actually the trimming line 74 is cut). At step 203, the monitor 103 displays the monitoring resistance value R ($=R_k=R_1$) that was set at step 235. Then, it is again judged at step 210 whether or not the relationship $R_b \leqq R < \beta_6$ is satisfied. In this judgment, the parameter R is equal to the monitoring resistance value that was set at step 235 and hence is equal to $R_1$. If the relationship $R_b \leqq R < \beta_6$ is satisfied, a judgment result "yes" is produced at step 210.

If step 232 has been executed or a judgment result "yes" is produced at step 210 as described above, "1" is added to the variable k to update it to 2; that is, k=k+1=2. Since $k=2 \leqq n=6$, a judgment result "yes" is produced at step 220. In this case, since k=2, it is judged at step 230 whether or not a relationship $R_{k-1}=R_1<\beta_n=\beta_2$ is satisfied. The parameter $R_1$ represents the above-mentioned resistance value (see step 232 or step 235) of the precursor 70 after the completion of the trimming processing on the trimming line 74. The parameter $\beta_2$ represents the threshold value as the judgment reference for trimming processing on the trimming line 75.

If the relationship $R_{k-1}=R_1<\beta_2$ is not satisfied, a judgment result "no" is produced at step 230. This means that the trimming line 75 need not be cut. In this case, since k=2 at this stage, the variable $R_k=R_2$ is set to R at step 232. The parameter $R_2$ represents a resistance value of the precursor 70 after completion of the trimming processing on the trimming line 75 (actually the trimming line 75 is not cut).

The resistance value $R_2$ is set to the monitoring resistance value R of the precursor 70 after the completion of the trimming processing on the trimming line 75 ($R_2=R$). After the execution of step 231, processing of displaying the monitoring resistance value R is performed at step 232. That is, the monitor 103 displays the monitoring resistance value $R=R_2$ which is supplied from the computer 102.

On the other hand, if the relationship $R_{k-1}=R_1<\beta_2$ is satisfied at step 230, a judgment result "yes" is produced. In this case, processing of driving the laser 90 is performed at step 233. As a result of the drive processing, the controller 110 performs a drive control so that the beam outlet of the laser 90 will be located right over the trimming line 75 of the precursor 70. As a result, the laser 90 is moved so that its beam outlet will be located right over the trimming line 75 of the precursor 70.

At the next step 234, processing of cutting the $k_2$th trimming line is performed. This cutting processing is processing of cutting the trimming line 75. In this processing, the laser 90 emits a laser beam toward the trimming line 75 under the control of the controller 110. The trimming line 75 is thus cut.

After the execution of step 234, the variable $R_k=R_2$ is set to R at step 235 as is done at step 231. The parameter $R_2$ represents a resistance value of the precursor 70 after completion of the trimming processing on the trimming line 75 (actually the trimming line 75 is cut). At step 203, the monitor 103 displays the monitoring resistance value R ($=R_k=R_2$) that was set at step 235. Then, it is again judged at step 210 whether or not the relationship $R_b \leqq R < \beta_6$ is satisfied. In this judgment, the parameter R is equal to the monitoring resistance value that was set at step 235 and hence is equal to $R_2$. If the relationship $R_b \leqq R=R_2<\beta_6$ is satisfied, a judgment result "yes" is produced at step 210.

From this time onward, steps 211 to 232 or steps 211 to 210 (via step 230) are executed repeatedly in the same manner as described with the variable k becoming equal to 6 at step 211 in the last cycle. While these steps are executed repeatedly, trimming processing is performed on each of the remaining trimming lines 76-79 (each of the trimming lines 76-79 is cut or not cut). If "1" is added to the variable k to update it to 7 (k=k+1=7) at step 211 after these steps are executed repeatedly, a judgment result "no" is produced at step 220.

When the computer program has proceeded to step 210, if the judgment result of step 210 is "no," "1" is added to the variable k to update it at step 212 (see FIG. 6) as is done at step 211 (step 212 is repeated as the variable k is changed from "0" to "6"). Every time "1" is added to the variable k to update it, whether or not the relationship $k \leqq n=6$ is satisfied is judged at step 240 as is done at step 220. If a judgment result "yes" is produced at step 240, the variable $R_k$ is set to $R_{k-1}$. That is, $R_1$ is set to $R_0$ when k=1, $R_2$ is set to $R_1$ when k=2, and so forth. When k=6, $R_6$ is set to $R_5$. When k=7, a judgment result "no" is produced at step 240.

Pieces of trimming processing are performed on the precursor 70 in the above-described manner, whereby the resistance value of the precursor 70 is adjusted to the target resistance value Ra. The precursor 70 whose resistance value has thus been adjusted serves as the platinum resistor 20.

After the precursor 70 is trimmed in the above-described manner, paste having alumina as the main component is screen-printed on the front surface 11 of the substrate 10 so as to cover a right-hand portion of the left-hand pad 30 (as viewed in FIG. 1) and a left-hand portion of the right-hand pad 30 (as viewed in FIG. 1), whereby a paste layer to become the bonding layer 40 is formed. Then, a protective layer 50 is laid on the paste layer by pressing. Then, the substrate 10 on which the protective layer 50 is laid is fired. The manufacture of a platinum-resistor-type temperature sensor is thus finished. The firing turns the paste layer into the bonding layer 40.

In the thus-manufactured temperature sensor, the platinum resistor 20 has the target resistance value Ra because the resistance value of the precursor 70 has been adjusted in the above-described manner by trimming.

As mentioned above, the precursor 70 is configured so as to satisfy the precursor conditions (1)-(4). Since the resistance value of the precursor 70 is adjusted to the target resistance value by the resistance value adjustment by trimming according to the flowchart of FIGS. 5 and 6, the resistance value of the precursor 70 can easily be adjusted to the target resistance value without the need for relying on an enormous amount of data as in the conventional case.

Since the computer program which is necessary for the above resistance value adjustment is based on the flowchart of FIGS. 5 and 6, the computer program can be written easily whereas an enormous amount of data as needed in the conventional case is made unnecessary.

To evaluate the resistance value fitting according to the first embodiment (i.e., the adjustment of the resistance value of the precursor 70 to a target value), a precursor having substantially the same structure as the above-described precursor 70 was prepared as Example and precursors of two Comparative Examples (Comparative Example 1 and Comparative Example 2) were also prepared.

In the precursor of Example, the common ratio of a geometric sequence having a general term $\alpha_k$ is set at 0.59. The precursor of Example is configured in substantially the same manner as the precursor 70 so as to be trimmed by the above-described trimming apparatus according to the flowchart of FIGS. 5 and 6.

On the other hand, in the precursor of Comparative Example 1, the common ratio of a geometric sequence having a general term $\alpha_k$ is set at 0.50. Therefore, the precursor of Comparative Example 1 has a resistance pattern whose resistance values are weighted so as to have a relative value sequence of $2^n$ like the precursor disclosed in Japanese Utility Model Application Laid-Open No. Sho 63-187303. Therefore, the precursor of Comparative Example 1 is trimmed by the above-described trimming apparatus according to a flowchart of FIG. 7 rather than the flowchart of FIGS. 5 and 6.

In the precursor of Comparative Example 2, the common ratio of a geometric sequence having a general term $\alpha_k$ is set at 0.5. Like the precursor 70, the precursor of Comparative Example 2 is trimmed by the above-described trimming apparatus according to the flowchart of FIGS. 5 and 6. Therefore, the precursor of Comparative Example 2 has the same resistance pattern as that of Example except for the difference in common ratio. The variable k takes values 1, 2, . . . , 10 for the general term $\alpha_k$, the target resistance value Ra is set at 200 Ω, and the lower limit resistance value Rb is set at 133.33 Ω.

First, the precursor of Comparative Example 1 is trimmed in the following manner according to the flowchart of FIG. 7. That is, it is judged at step 300 whether or not a pre-trimming resistance value (i.e., monitoring resistance value R) of the precursor of Comparative Example 1 satisfies a relationship $Rb \leqq R \leqq Ra-C$, where C is an allowable error of a target resistance value.

If the relationship $Rb \leqq R \leqq Ra-C$ is satisfied, a judgment result "yes" is produced at step. 300 At the next step 310, processing of determining trimming portions (cutting portions) of the precursor of Comparative Example 1 is performed. This determining processing is performed on the basis of $2^8$ combinations.

As described below, the number of combinations is enormous. In Comparative Example 1, plural resistance adjustment patterns are arranged in such a manner that their resistance values are weighted so as to have such relative values as to provide $2^8$ resistance values. Therefore, in determining trimming portions (i.e., portions to be trimmed) in Comparative Example 1, the number of combinations of trimming portions and an initial resistance value amounts to $2^8$.

When cutting portions of the precursor of Comparative Example 1 have been determined on the basis of the above-mentioned $2^8$ combinations at step 310, cutting is performed at step 320 for each determination of a cutting portion. Cutting is performed by a laser beam emitted from the laser 90. Like the precursor of the above-mentioned Example, the precursor of Comparative Example 2 is trimmed according to the flowchart of FIGS. 5 and 6.

Figures 8, 9:
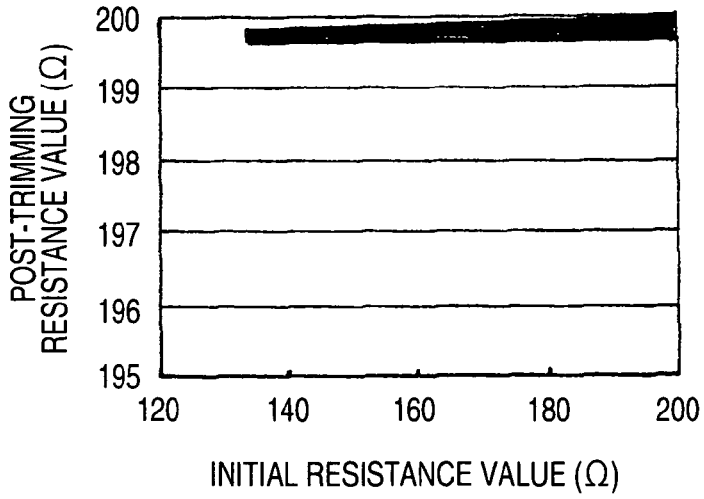
FIG. 8 is a table showing a resistance variation ratio at the time of cutting of a trimming portion for $\alpha_k$ (k=1 to 10) in Example of and Comparative Examples 1 and 2 for the first embodiment.
FIG. 9 is a graph showing a relationship between the post-trimming resistance value and the initial resistance value of a precursor of Example of the first embodiment.

The trimming methods of Example and Comparative Examples 1 and 2 produced results shown in a table of FIG. 8. In the table of FIG. 8, the term "resistance variation ratio at the time of cutting of a trimming portion" means a ratio of a post-cutting resistance value to a pre-cutting resistance value (i.e., initial resistance value).

As shown in the table of FIG. 8, in each of Example and Comparative Examples 1 and 2, the sum of the resistance variation ratios at the time of cutting of the trimming portions is equal to 0.498. Whereas in Comparative Example 1 the number of threshold values is as enormous as $2^8-1=255$, in Comparative Example 2 the number of threshold values is only eight. In Example, the number of threshold values is 10.

Figure 10:
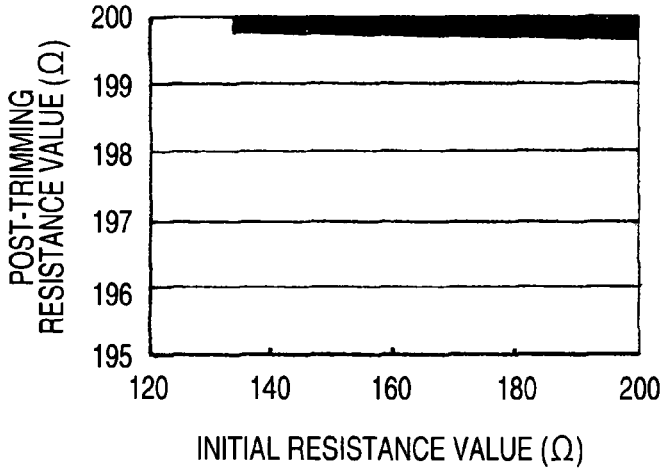
FIG. 10 is a graph showing a relationship between the post-trimming resistance value and the initial resistance value in Comparative Example 1 for the embodiment.
Figure 11:
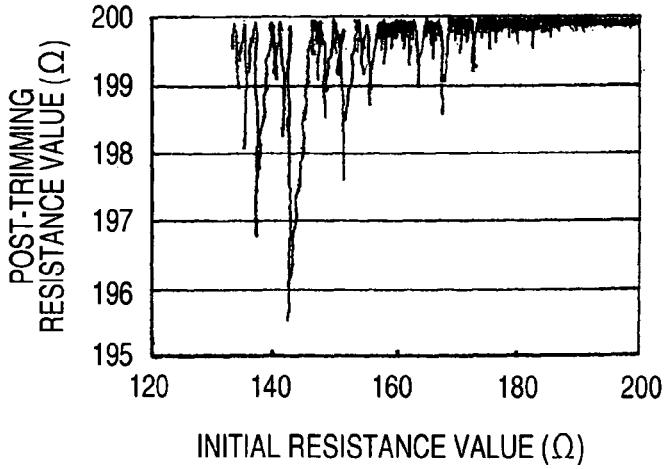
FIG. 11 is a graph showing a relationship between the post-trimming resistance value and the initial resistance value in Comparative Example 2 for the first embodiment.

FIGS. 9-11 are graphs showing relationships between the pre-trimming resistance value (i.e., initial resistance value) and the post-trimming resistance value in Example and Comparative Examples 1 and 2. FIG. 9 is a graph corresponding to Example, FIG. 10 is a graph corresponding to Comparative Example 1, and FIG. 11 is a graph corresponding to Comparative Example 2.

The comparison between these graphs shows that the resistance value can be fit into the target range in each of Example and Comparative Example 1. However, in Comparative Example 1, since $2^8$ combinations are indispensable in determining cutting portions, the number of threshold values is as enormous as 255. Therefore, not only does the flowchart of FIG. 7 (i.e., a computer program) is complex but also the above-mentioned enormous number of combinations and hence the enormous number of threshold values is needed. As a result, it takes much time and labor to generate data for trimming of the precursor of Comparative Example 1.

In contrast, only 10 threshold values are needed in Example. Therefore, not only the flowchart of FIGS. 5 and 6 (i.e., a computer program) is simple but also the number of threshold value is very small and hence data for trimming of the precursor of Example can be generated easily.

In Comparative Example 2, as is understood from the fact that in the graph of FIG. 11 the post-trimming resistance value varies to a large extent with respect to the initial resistance value, the resistance value cannot be fit to the target resistance value Ra.

Although the first embodiment is directed to the case that the precursor 70 has six trimming lines, the invention is not limited to such a case. As long as it is prerequisite that Inequality (1) be satisfied, it is sufficient for the precursor 70 to have at least three trimming lines.

Second Embodiment

Next, a second embodiment of the invention will be described. In the second embodiment, in general, the following precursor conditions are set:

(1) As in the case of the first embodiment, the precursor has a meandering resistance pattern which is formed on the front surface 11 of the substrate 10.

(2) Unlike in the first embodiment, the precursor has at least two trimming lines.

(3) As in the case of the first embodiment, Inequality (1) holds for the general term $\alpha_k$ of a sequence.

(4) Unlike in the first embodiment, in the second embodiment the sequence is not required to be a geometric sequence. However, the general term $\alpha_k$ should satisfy the following Equation (2).

$$\left(1+\sum_{i=1}^{k}\alpha_i\right)(1+\alpha_k)=(1+\alpha_1)^2 \tag{2}$$

Figure 12:
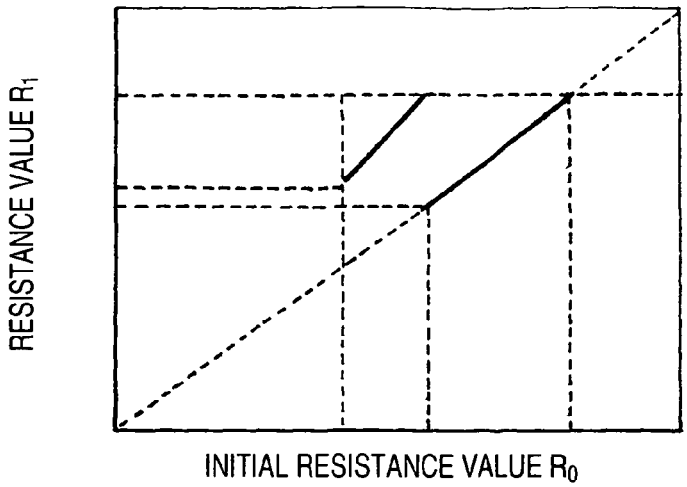
FIG. 12 is a graph showing a relationship between the resistance value $R_1$ and the initial resistance value $R_0$ in a state that a term $\alpha_1$ of a sequence has not been optimized yet in the second embodiment of the invention.

The grounds of formulation of Equation (2) will be described below with reference to FIGS. 12-17. FIG. 12 shows a relationship between the initial resistance value $R_0$ and the resistance value $R_1$ that is obtained by performing trimming processing on the first trimming line (i.e., the first trimming line is cut or not cut). In this embodiment, the initial resistance value $R_0$, which is a resistance value before a start of a trimming operation, should satisfy a relationship $Rb \leqq R_0 \leqq Ra$. In this relationship, the resistance value $R_1$ is given by two separate line segments. If a relationship $R_0<\beta_1$ (see step 230 in FIG. 5) is satisfied, the first trimming line is cut. On the other hand, if $R_0 \geqq \beta_1$, the first trimming line is not cut.

As for the minimum value of the resistance value $R_1$, which depends on the value of $\beta_1$, one of the following two cases occurs. If the initial resistance value $R_0$ is equal to $\beta_1$, the minimum value $R_{1min}$ of $R_1=\beta_1$ is given by $Ra/(1+\alpha_1)$. If the initial resistance value $R_0$ is equal to Rb, the minimum value $R_{1min}$ of $R_1$ is given by $Rb(1+\alpha_1)$ under the condition $R_0<\beta_1$.

Figure 13:
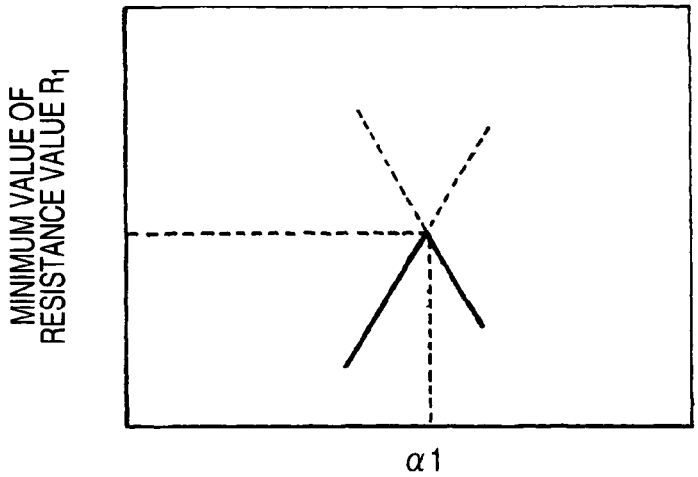
FIG. 13 is a graph showing how the minimum value $R_{1min}$ of the resistance value $R_1$ varies with the value of the term $\alpha_1$ of the sequence in the second embodiment.
Figure 14:
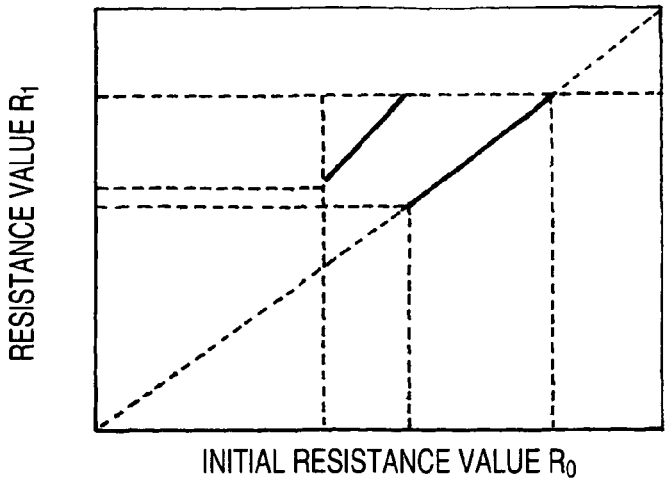
FIG. 14 is a graph showing a relationship between the resistance value $R_1$ and the initial resistance value $R_0$ in the second embodiment.

Therefore, the dependence of the minimum value $R_{1min}$ of the resistance value $R_1$ on $\alpha_1$ is as shown in a graph of FIG. 13. As shown in FIG. 13, $\alpha_1$ takes an optimum value and the minimum value $R_{1min}$ of the resistance value $R_1$ is at the maximum (see FIG. 14) when a relationship $Ra/(1+\alpha_1)=Rb(1+\alpha_1)$, that is, $(1+\alpha_1)^2=Ra/Rb$, holds.

Figure 15:
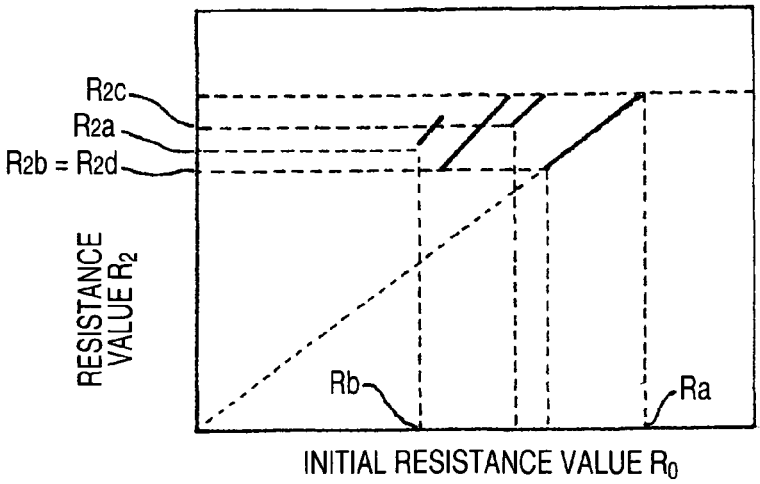
FIG. 15 is a graph showing a relationship between the resistance value $R_2$ and the initial resistance value $R_0$ in a state that the term $\alpha_1$ of the sequence has been optimized but its term $\alpha_2$ has not been optimized yet in the second embodiment.

FIG. 15 shows a relationship between the initial resistance value $R_0$ and the resistance value $R_2$ that is obtained by performing trimming processing on the second trimming line (i.e., the second trimming line is cut or not cut). In this relationship, the resistance value $R_2$ is given by four separate line segments, the left ends of which are the follows four points:

a) A point where $R_0$ is equal to Rb. In this case, the resistance value $R_2$ is given by $R_{2a}=Rb(1+\alpha_1+\alpha_2)$ b) A point where the resistance value $R_1$ obtained after the first trimming line is cut becomes $\beta_2$. In this case, the resistance value $R_2$ is given by $R_{2b}=\beta_2=Ra/(1+\alpha_2)$.

c) A case that the initial resistance value $R_0$ is equal to $\beta_1$. In this case, the resistance value $R_2$ is given by $R_{2c}=\{Ra/(1+\alpha_1)\}(1+\alpha_2)$ d) A case that the initial resistance value $R_0$ is equal to $\beta_2$. In this case, the resistance value $R_2$ is given by $R_{2d}=Ra/(1+\alpha_2)$.

Substituting $(1+\alpha_1)^2=Ra/Rb$ into the above values $R_{2a}$, $R_{2b}$, $R_{2c}$, and $R_{2d}$, we obtain $$R_{2a}=\{Ra/(1+\alpha_1)^2\}(1+\alpha_1+\alpha_2)=Rb(1+\alpha_1+\alpha_2)$$

$$R_{2b}=Ra/(1+\alpha_2)=Rb(1+\alpha_1)^2/(1+\alpha_2)$$

$$R_{2c}=\{Ra/(1+\alpha_1)\}(1+\alpha_2)=Rb(1+\alpha_1)(1+\alpha_2)$$

$$R_{2d}=Ra/(1+\alpha_2)=Rb(1+\alpha_1)^2/(1+\alpha_2).$$

Since a relationship $R_{2a}<R_{2c}$ holds apparently, the minimum value $R_{2min}$ of the resistance value $R_2$ is equal to one of $$R_{2a}=R_0/\{(1+\alpha_1+\alpha_2)(1+\alpha_1)^2\}=Rb/(1+\alpha_1+\alpha_2);\text{ and}$$

$$R_{2d}=R_0/(1+\alpha_2)=Rb(1+\alpha_1)^2/(1+\alpha_2)$$

depending on the value of $\alpha_2$.

Figure 16:
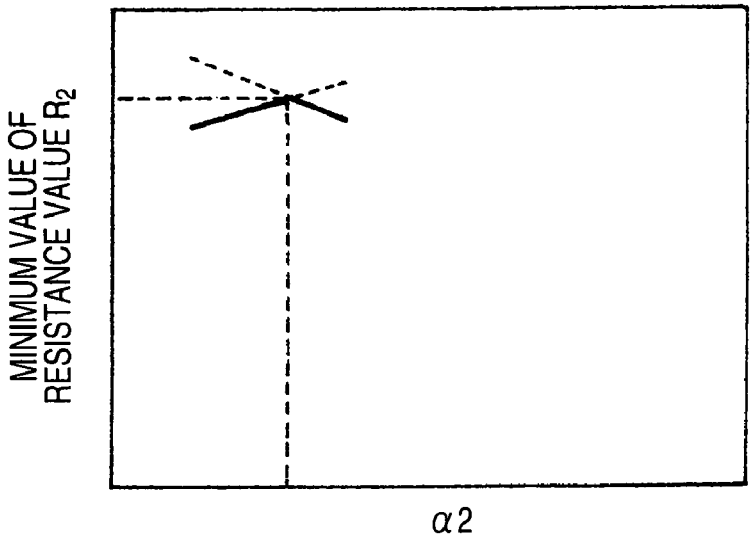
FIG. 16 is a graph showing how the minimum value $R_{2min}$ of the resistance value $R_2$ varies with the value of the term $\alpha_2$ of the sequence in a state that the term $\alpha_1$ of the sequence has been optimized in the second embodiment.
Figure 17:
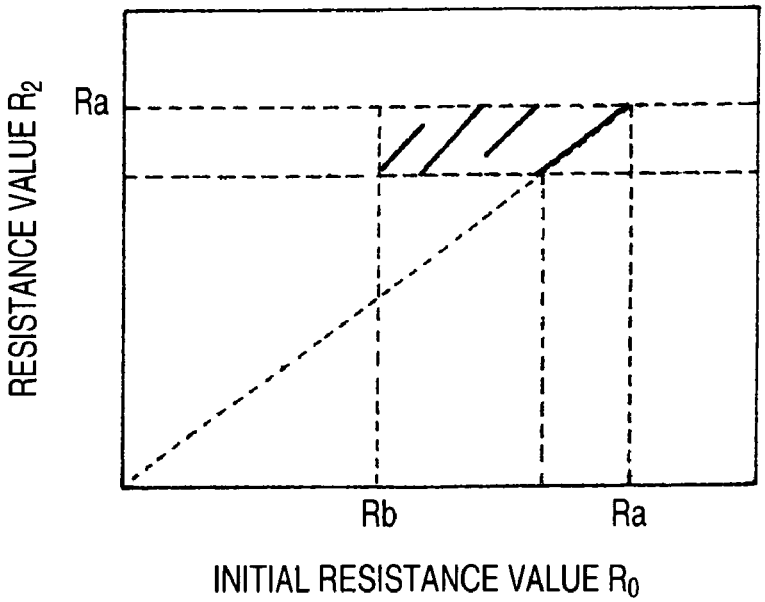
FIG. 17 is a graph showing a relationship between the resistance value $R_2$ and the initial resistance value $R_0$ in a state that the terms $\alpha_1$ and $\alpha_2$ of the sequence have been optimized in the second embodiment.

FIG. 16 is a graph showing the dependence of the minimum value $R_{2min}$ (i.e., $R_{2a}$ or $R_{2d}$) of the resistance value $R_2$ on $\alpha_2$. As is apparent from FIG. 16, the minimum value $R_{2min}$ of the resistance value $R_2$ has a largest value when $R_{2a}=R_{2d}$, that is, $(1+\alpha_2)(1+\alpha_1\alpha_2)=(1+\alpha_1)^2$ (see FIG. 17).

Likewise, the minimum value of the resistance value $R_k$ has a largest value when $Rb(1+\alpha_1+\alpha_2+\ldots+\alpha_k)=Rb=Ra/(1+\alpha_k)$, that is, $$\left(1+\sum_{i=1}^{k}\alpha_i\right)(1+\alpha_k)=Ra/Rb=(1+\alpha_1)^2.$$

From the above discussion, it can be said that the resistance pattern of the precursor 70 according to the second embodiment satisfies the above-mentioned Equation (2).

The precursor 70 is required to have n trimming lines, n satisfying a relationship $(Ra-C)\leqq Ra/(1+\alpha_n)$. This is because if $Ra/(1+\alpha_n)<(Ra-C)$, the resistance value of a precursor whose initial value $R_0$ satisfies a relationship $Ra/(1+\alpha_n)<R_0<(Ra-C)$ cannot be adjusted by trimming processing so that a relationship $(Ra-C)\leqq R_n\leqq Ra$ is satisfied.

Where n is set in the above-described manner, a range of the initial resistance value $R_0$ where the relationship $(Ra-C)\leqq R_n\leqq Ra$ can be satisfied by trimming processing is given by $(Ra-C)/(1+S_n)\leqq Ra/\{(1+S_n)(1+\alpha_n)\}<R_0\leqq Ra$, where $(1+S_{n)=(}1+\alpha_1+\alpha_2+\ldots+\alpha_n)$ As for the range of the initial resistance value of a precursor as a subject of trimming, if $(Ra-C)/(1+S_n)\leqq R_0\leqq Ra/\{(1+S_n)(1+\alpha_n)\}=Rb$, a post-trimming resistance value $R_n$ of the precursor can be fit into a range $(Ra-C)\leqq R_n\leqq Ra/(1+\alpha_n)$ by cutting all the trimming lines.

If $Ra/\{(1+S_n)(1+\alpha_n)\}<R_0\leqq Ra/(1+\alpha_n)$, a post-trimming resistance value $R_n$ of the precursor can be fit into a target resistance value range $Ra/(1+\alpha_n)\leqq R_0\leqq Ra$.

A precursor 70 produced by patterning in the manner described in the first embodiment has the prescribed resistance pattern and six trimming lines (see FIG. 3). Therefore, this precursor 70 satisfies the precursor conditions (1) and (2) of the second embodiment.

It is assumed that the resistance pattern of the precursor 70 according to the second embodiment satisfies the precursor condition (3) of the second embodiment as in the case of the first embodiment. It is also assumed that the resistance pattern of the precursor 70 according to the second embodiment is a modified version of that of the precursor 70 according to the first embodiment in that the former satisfies the precursor condition (4) of the second embodiment If pieces of trimming processing are performed on the thus-configured precursor 70 according to the second embodiment in the same manner as in the first embodiment by using the trimming apparatus by causing the computer 102 to run the computer program (see the flowchart of FIGS. 5 and 6), the resistance value of the precursor 70 is adjusted to the target resistance value Ra. The precursor 70 whose resistance value has thus been adjusted serves as the platinum resistor 20.

Therefore, the same workings and advantages as attained by the first embodiment can be attained by using the precursor 70 according to the second embodiment.

To evaluate the resistance value fitting according to the second embodiment, a precursor having substantially the same structure as the precursor according to the second embodiment was prepared as Example. The same trimming processing as is to be performed on the precursor 70 according to the second embodiment was performed on the precursor of Example. A table of FIG. 18 shows a result of the trimming processing.

Figures 18, 19:
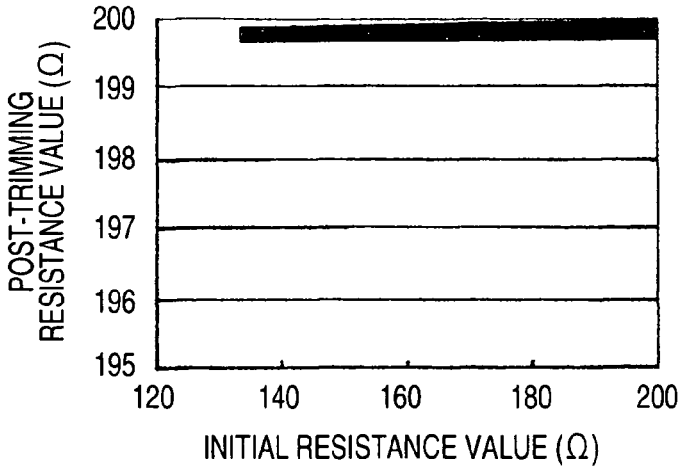
FIG. 18 is a table showing a resistance variation ratio at the time of cutting of a trimming portion for $\alpha_k$ (k=1 to 10) in Example of the second embodiment.
FIG. 19 is a graph showing a relationship between the post-trimming resistance value and the initial resistance value in Example of the second embodiment.

As shown in the table of FIG. 18 and the table of FIG. 8 (first embodiment), the sum of resistance variation ratios at the time of cutting of the trimming portions is equal to 0.498 in each of Comparative Examples 1 and 2 and Example of the second embodiment. Whereas in Comparative Example 1 the number of threshold values is as enormous as $2^8-1=255$, in Example of the second embodiment the number of threshold values is only 10.

FIG. 19 is a graph showing a relationship between the pre-trimming resistance value (i.e., initial resistance value) and the post-trimming resistance value in Example of the second embodiment. It is seen from FIG. 19 that in Example of the second embodiment the resistance value can be fit into a target range.

Third Embodiment

FIGS. 20-25 show important features of a third embodiment of the invention. The third embodiment is different from the first or second embodiment in that the former is proposed with the following items taken into consideration.

In the same manner as described in the first or second embodiment, meandering resistance patterns 71 formed on the substrate 10 are designed so that resistance variation ratios at the time of cutting of trimming lines become equal to target values. In designing meandering resistance patterns 71, it is assumed that the general term $\alpha_k$ in Inequality (1) or Equation (2) described in the first or second embodiment has no variation.

However, in actuality, the resistance patterns 71 have variations in width and thickness as well as in pattern accuracy. Therefore, the general term $\alpha_k$ actually has a variation and hence each of the above-mentioned resistance variation ratios varies from one resistance element to another.

Therefore, since the resistance value can be adjusted only in the increasing direction in cutting trimming lines in the above-described manner, the resistance value may increase beyond a target range by cutting trimming lines if such variations are not taken into consideration.

A desirable measure against the above problem is to employ larger resistance variation ratios in determining trimming lines to be cut taking such variations into consideration or setting a post-trimming target resistance value smaller.

In view of the above, in the third embodiment, it was studied how the variation of the general term $\alpha_k$ influences the resistance variation ratio at the time of cutting of a trimming line.

In this study, precursors of Examples 1-5 and Comparative Examples 1-4 were prepared. The precursor of Example 1 is the same as that of Example of the first embodiment. The precursor of Example 2 is the same as that of Example of the second embodiment. The precursors of Comparative Examples 1 and 2 are the same as those of Comparative Examples 1 and 2 for the first embodiment. Therefore, in Examples 1 and 2 and Comparative Examples 1 and 2, the variation of the general term $\alpha_k$ is not taken into consideration.

The precursors of Examples 3-5 were prepared as precursors that are configured substantially in the same manner as the precursor 70 according to the first or second embodiment except for the trimming lines. Whereas the precursor 70 according to the first or second embodiment has the six trimming lines, the precursors of Examples 3 and 4 have eight trimming lines and the precursors of Example 5 has 10 trimming lines.

In Example 3, the common ratio of the general term $\alpha_k$ of Inequality (1) of the geometric sequence described in the first embodiment is set at 0.59. In Examples 4 and 5, it is assumed that the general term $\alpha_k$ satisfies Equation (2) described in the second embodiment.

The precursors of Examples 3-5 are configured so as to be able to be trimmed by the trimming apparatus described in the first embodiment according to the flowchart of FIGS. 5 and 6.

The precursors of Comparative Examples 3 and 4 are configured in the same manners as those of Comparative Examples 1 and 2 for the first embodiment.

However, in Comparative Example 3, the common ratio of the general term $\alpha_k$ of Inequality (1) of the geometric sequence described in the first embodiment is set at 0.50. The precursor of Comparative Example 3 is configured so as to be able to be trimmed by the trimming apparatus described in the first embodiment according to the flowchart of FIGS. 5 and 6.

In Comparative Example 4, as in the case of Comparative Example 3, the common ratio of the general term $\alpha_k$ of Inequality (1) of the geometric sequence described in the first embodiment is set at 0.50. The precursor of Comparative Example 4 is configured so as to be able to be trimmed by the trimming apparatus described in the first embodiment according to the flowchart of FIG. 7.

In Examples 3-5 and Comparative Examples 3 and 4, as in the case of the first embodiment, the target resistance value Ra was set at 200 Ω and the lower limit value Rb of the initial resistance value was set at 133.3 Ω.

Figure 7:
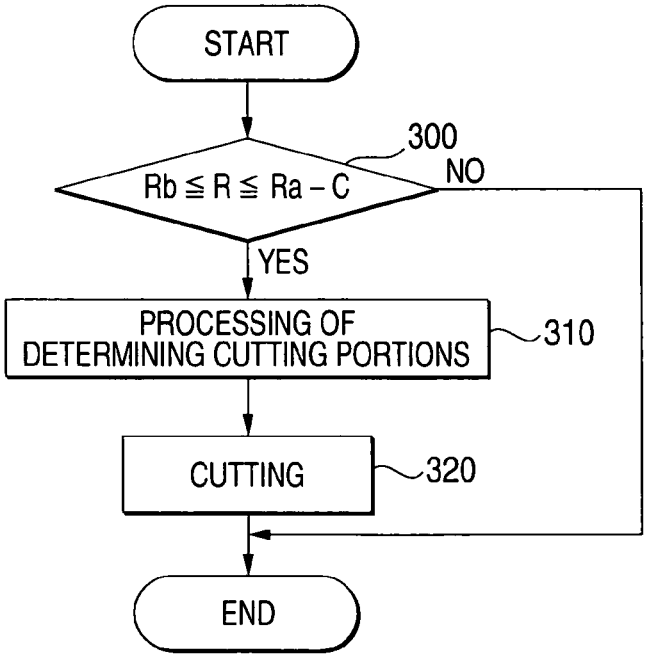
FIG. 7 is a flowchart which is executed by the computer to trim a precursor of Comparative Example 1 for the first embodiment.

The precursors of Examples 3-5 and Comparative Example 3 were trimmed by the trimming apparatus described in the first embodiment according to the flowchart of FIGS. 5 and 6, and the precursor of Comparative Example 4 was trimmed by the trimming apparatus described in the first embodiment according to the flowchart of FIG. 7. Results are shown in a table of FIG. 20.

In this table, as described in the first embodiment, the term "resistance variation ratio at the time of cutting of a trimming portion" means a ratio of a post-cutting resistance value to a pre-cutting resistance value (i.e., initial resistance value) In the third embodiment, the variation range of $\alpha_k$ described in the first embodiment is taken into consideration. More specifically, in the third embodiment, $\alpha_k$ is redefined as an average of plural $\alpha_k$'s. For example, taking a variation range of $\alpha_1$ as described in the first embodiment, $\alpha_1$ as used in the third embodiment is an average of plural $\alpha_1$'s.

In the table of FIG. 20, to prevent a post-trimming resistance value from exceeding the target resistance value Ra, a value obtained by adding $3\sigma_k$ to $\alpha_k$ as used in the third embodiment is employed instead of $\alpha_k$ as used in the third embodiment in determining trimming lines to be cut, where $\sigma_k$ means the standard deviation of $\alpha_k$ as used in the third embodiment.

In the table of FIG. 20, a value obtained by subtracting $3\sigma_k$ from $\alpha_k$ as used in the third embodiment is employed for every trimming line as an example corresponding to a value close to the minimum value of the variation range of $\alpha_k$ as used in the third embodiment.

It is therefore understood that the variation of the general term $\alpha_k$ is taken into consideration in Examples 3-5 and Comparative Examples 3 and 4.

FIGS. 21-25 are graphs which are based on the table of FIG. 20 and show relationships between the pre-trimming resistance value (i.e., initial resistance value) and the post-trimming resistance value in Examples 3-5 and Comparative Examples 3 and 4.

Figure 21:
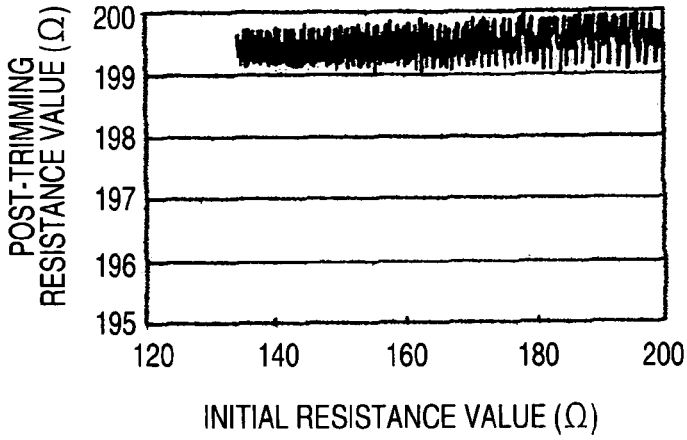
FIG. 21 is a graph showing a relationship between the post-trimming resistance value and the initial resistance value in Example 3 of the third embodiment.
Figure 22:
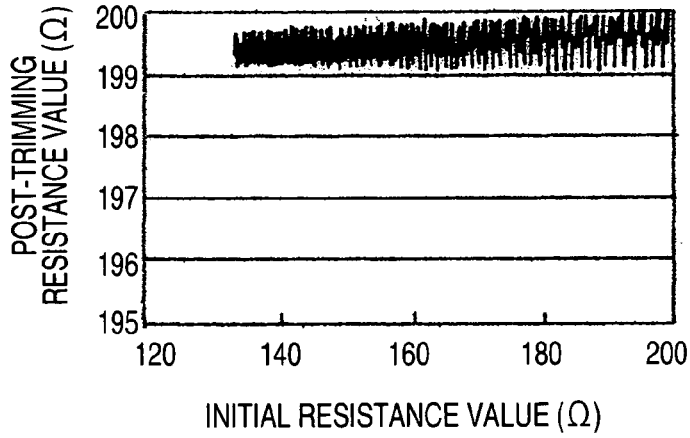
FIG. 22 is a graph showing a relationship between the post-trimming resistance value and the initial resistance value in Example 4 of the third embodiment.
Figure 23:
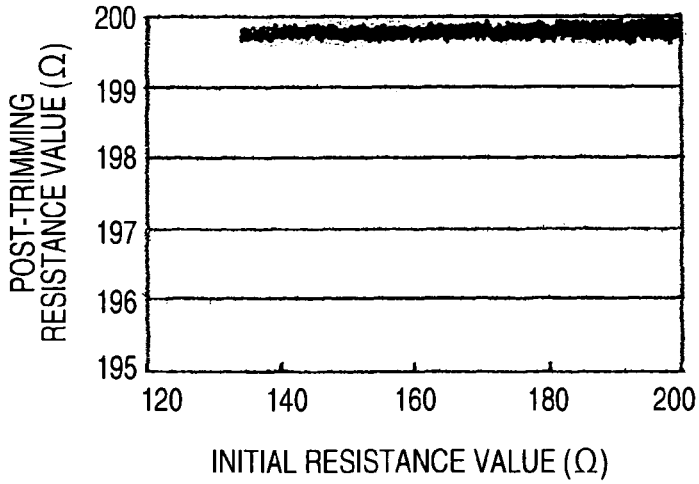
FIG. 23 is a graph showing a relationship between the post-trimming resistance value and the initial resistance value in Example 5 of the third embodiment.
Figure 24:
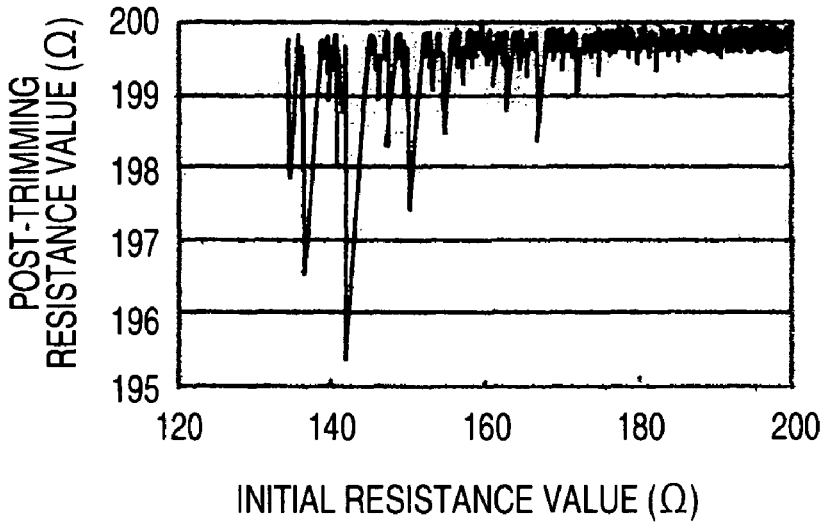
FIG. 24 is a graph showing a relationship between the post-trimming resistance value and the initial resistance value in Comparative Example 3 for the third embodiment.
Figure 25:
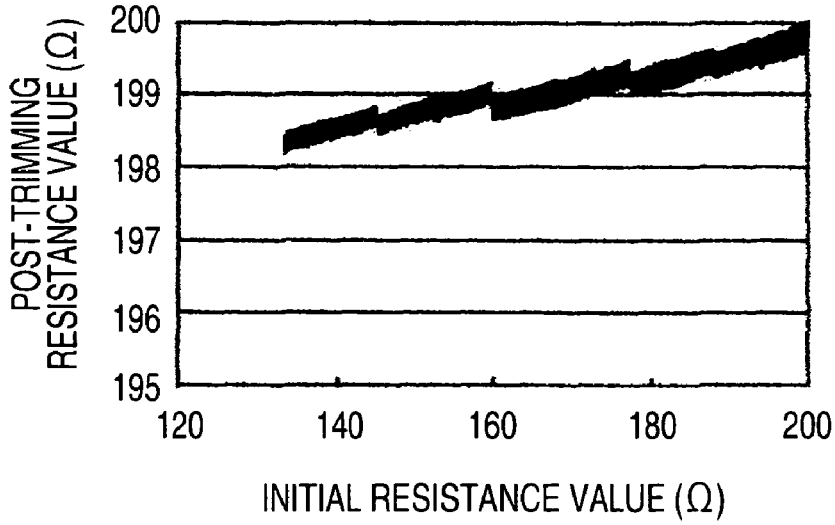
FIG. 25 is a graph showing a relationship between the post-trimming resistance value and the initial resistance value in Comparative Example 4 for the third embodiment.

FIG. 21 is a graph corresponding to Example 3, FIG. 22 is a graph corresponding to Example 4, FIG. 23 is a graph corresponding to Example 5, FIG. 24 is a graph corresponding to Comparative Example 3, and FIG. 25 is a graph corresponding to Comparative Example 4.

Among these graphs, compare the graph of FIG. 21 (corresponds to Example 3) with the graph of FIG. 9 (corresponds to Example 1) described in the first embodiment. As is understood from the description of the first embodiment, the graph of FIG. 9 shows that the resistance value can be fit into the target range with an assumption that the variation of the general term $\alpha_k$ is not taken into consideration.

In contrast, the graph of FIG. 21 shows that the resistance value can be fit into the target range even in the case where the variation of the general term $\alpha_k$ is taken into consideration.

Compare the graph of FIG. 22 (corresponds to Example 4) and the graph of FIG. 23 (corresponds to Example 5) with the graph of FIG. 19 (corresponds to Example 2) described in the second embodiment. As is understood from the description of the second embodiment, the graph of FIG. 19 shows that the resistance value can be fit into the target range with an assumption that the variation of the general term $\alpha_k$ is not taken into consideration.

In contrast, the graphs of FIGS. 22 and 23 show that the resistance value can be fit into the target range even in the case where the variation of the general term $\alpha_k$ is taken into consideration.

In the graph of FIG. 23, the variation of the post-trimming resistance value is smaller than in the graph of FIG. 22, which is because the number (10) of trimming lines in Example 5 is larger than the number (eight) of trimming lines in Example 1. This indicates that the resistance value can be fit into the target range more easily as the number of trimming lines increases.

Compare the graph of FIG. 24 (corresponds to Comparative Example 3) with the graph of FIG. 11 (corresponds to Comparative Example 2) described in the first embodiment. The graph of FIG. 11 shows that as described in the first embodiment the post-trimming resistance value varies to a large extent with the initial resistance value and hence the resistance value cannot be fit into the target range, though it is assumed that the variation of the general term $\alpha_k$ is not taken into consideration.

In contrast, in the graph of FIG. 24, since the variation of the general term $\alpha_k$ is taken into consideration, the post-trimming resistance value varies with the initial resistance value a little more than in the graph of FIG. 11. Therefore, it is more difficult to fit the resistance value into the target range.

Compare the graph of FIG. 25 (corresponds to Comparative Example 4) with the graph of FIG. 10 (corresponds to Comparative Example 1) described in the first embodiment. The graph of FIG. 10 shows that as is understood from the description of the first embodiment the post-trimming resistance value can be fit into the target range with an assumption that the variation of the general term $\alpha_k$ is not taken into consideration.

In contrast, in the graph of FIG. 25, since the variation of the general term $\alpha_k$ is taken into consideration, the post-trimming resistance value varies to a large extent with the initial resistance value. Therefore, since the general term $\alpha_k$ actually has a variation, there may occur a case that the resistance value cannot be fit into the target range.

Compare the graph of FIG. 25 (corresponds to Comparative Example 4) with the graphs of FIGS. 21 and 22 (correspond to Example 3 and Example 4) to discuss the graph of FIG. 25 further. In the graph of FIG. 25 the post-trimming resistance value is smaller than in the graphs of FIGS. 21 and 22 in a range where the initial resistance value is small. This is because variations of the resistance variation ratios of trimming lines accumulate rather than cancel out each other. In addition, the resistance adjustment accuracy is not increased much even if trimming lines with small resistance variation ratios are provided by increasing the number of trimming lines.

As is apparent from the above description, in Examples 3-5 of the third embodiment, the resistance value can be fit into the target range even if the variation of the general term $\alpha_k$ is taken into consideration. This means that the result is the same even if the variation of the general term $\alpha_k$ is not taken into consideration as in Example of the first or second embodiment.

This will be explained below in other words. As described in the first or second embodiment, every time one trimming line is cut or left uncut, the resistance value of the resistance patterns 71 is measured and whether to cut the next trimming line is determined on the basis of the threshold value ($\beta_k$) therefor. Therefore, a resistance-element-dependent resistance variation ratio at the time of cutting of a trimming line, that is, a resistance-element-dependent variation of the general term $\alpha_k$, is absorbed. As a result, even only with the trimming adjustment, the resistance value can be fit into the target range with relatively high accuracy.

Even where the variation of the general term $\alpha_k$ should be taken into consideration as in the case of the third embodiment, the post-trimming resistance value distribution range can be made narrower as the number of trimming lines is increased according to a prescribed rule, that is, as trimming lines with smaller resistance value variations are provided.

Therefore, where a ladder-shaped resistance pattern is used, it need not be trimmed. And analog trimming becomes unnecessary or trimming adjustment amounts can be reduced. As a result, resistance elements are miniaturized, the trimming processing time can be shortened, and resistance value errors can be reduced. These advantages lead to cost reduction, increase in production yield, and increase in thermal response speed. In the other points, the configuration and the workings and advantages are the same as those of the first or second embodiment.

The invention is not limited to the above embodiments and can be practiced in the form of the following various modifications:

(1) The resistor element is not limited to the platinum resistor 20 made of platinum of a temperature sensor. A resistor element that is a resistor or the like made of any of various resistor materials may be formed on the front surface 11 of the substrate 10. In this case, the same workings and advantages as attained by one of the above embodiments can be attained by forming a precursor 70 as described in the one embodiment as a precursor of the resistor element.

(2) The shape of the resistor pattern of the precursor 70 is not limited to the shape described in each embodiment. Satisfactory results are obtained as long as a meandering resistor pattern is employed.

(3) The shape of each trimming line is not limited to a linear shape. Satisfactory results are obtained as long as each trimming line is shaped so as to short-circuit a corresponding one of pairs of intermediate portions of the precursor 70.

(4) In general, satisfactory results are obtained as long as each trimming line is a short-circuiting portion for short-circuiting a corresponding one of pairs of intermediate portions of the precursor 70.

(5) The resistance value of the precursor 70 may be fit into a true target value by setting a target value smaller than the true one and trimming a ladder-shaped pattern or an analog trimming pattern portion provided in the precursor in advance at the end of a trimming operation on the precursor.

(6) Whether to cut a trimming line may be judged by judging whether a pre-trimming resistance value is smaller than or equal to a threshold value instead of judging whether the pre-trimming resistance value is smaller than the threshold value.

The invention has been described in detail by using the particular embodiments. However, it is apparent to a person skilled in the art that various changes and modifications are possible without departing from the spirit and scope of the invention.

This application is based on Japanese Patent Application No. 2004-147812, filed May 18, 2004, the disclosure of which is incorporated by reference herein.

The invention claimed is:

1. A precursor having a resistance pattern which is formed on a substrate with a resistance material in meandering form and short-circuiting portions which are formed so as to short-circuit plural pairs of longitudinal intermediate portions of the resistance pattern, respectively, characterized in:

that a normalized resistance value increase sequence obtained by arranging, in descending order, resistance value increases at the time of cutting of the respective short-circuiting portions and normalizing the resistance value increases by a resistance value obtained in a state that none of the short-circuiting portions are cut is a sequence which has terms $\alpha_k$'s (k=1, 2, 3, . . . ) and satisfies $(1+\alpha_1+\alpha_2+\ldots+\alpha_k)(1+\alpha_k)=(1+\alpha_1)^2$.

2. A precursor resistance value adjusting method in which a precursor having a resistance pattern which is formed on a substrate with a resistance material in meandering form and short-circuiting portions which are formed so as to short-circuit plural pairs of longitudinal intermediate portions of the resistance pattern, respectively, is prepared and a resistance value of the precursor is adjusted to a target resistance value by selectively cutting the short-circuiting portions, characterized in:

that the precursor is prepared as a precursor in which a normalized resistance value increase sequence obtained by arranging, in descending order, resistance value increases at the time of cutting of the respective short-circuiting portions and normalizing the resistance value increases by a resistance value obtained in a state that none of the short-circuiting portions are cut is defined as a sequence which has terms $\alpha_k$'s (k=1, 2, 3, . . . ) and satisfies $(1+\alpha_1+\alpha_2+\ldots+\alpha_k)(1+\alpha_k)=(1+\alpha_1)^2$; and that the resistance value of the precursor is adjusted to the target resistance value by repeating, in descending order of the cutting-induced resistance value increases of the short-circuiting portions of the thus-prepared precursor, processing of:

a first step of judging whether a resistance value of the precursor before cutting of the short-circuiting portion is smaller than a threshold value for the short-circuiting portion;

a second step of determining that the short-circuiting portion should be cut, if the first step judges that the resistance value of the precursor before cutting of the short-circuiting portion is smaller than the threshold value for the short-circuiting portion; and a step of judging, at the first step, skipping the second step, whether the resistance value of the precursor is smaller than a threshold value for a next short-circuiting portion whose cutting-induced resistance value increase is largest next to the cutting-induced resistance value increase of the current short-circuiting portion, if the first step judges that the resistance value of the precursor before cutting of the short-circuiting portion is larger than or equal to the threshold value for the short-circuiting portion;

while cutting the short-circuiting portion every time the second step judges that the short-circuiting portion should be cut, as the processing is repeated.

3. A resistance element which is produced from a precursor by preparing a precursor having a resistance pattern which is formed on a substrate with a resistance material in meandering form and short-circuiting portions which are formed so as to short-circuit plural pairs of longitudinal intermediate portions of the resistance pattern, respectively, and adjusting a resistance value of the precursor to a target resistance value by selectively cutting the short-circuiting portions, characterized in:

that the precursor is such that a normalized resistance value increase sequence obtained by arranging, in descending order, resistance value increases at the time of cutting of the respective short-circuiting portions and normalizing the resistance value increases by a resistance value obtained in a state that none of the short-circuiting portions are cut is defined as a sequence which has terms $\alpha_k$'s (k=1, 2, 3, . . . ) and satisfies $(1+\alpha_1+\alpha_2+\ldots+\alpha_k)(1+\alpha_{k)=(}1+\alpha_1)^2$;and that the resistance element is produced from the precursor by adjusting the resistance value of the precursor to the target resistance value by repeating, in descending order of the cutting-induced resistance value increases of the short-circuiting portions of the precursor, processing of cutting the short-circuiting portion if the resistance value of the precursor before cutting of the short-circuiting portion is smaller than a threshold value for the short-circuiting portion, leaving the short-circuiting portion uncut if the resistance value of the precursor before cutting of the short-circuiting portion is larger than or equal to the threshold value for the short-circuiting portion, and, with the current short-circuiting portion left uncut, cutting a next short-circuiting portion whose cutting-induced resistance value increase is largest next to the cutting-induced resistance value of the current short-circuiting portion if the resistance value of the precursor before cutting of the next short-circuiting portion is smaller than a threshold value for the next short-circuiting portion or leaving the next short-circuiting portion uncut if the resistance value of the precursor before cutting of the next short-circuiting portion is larger than or equal to the threshold value for the next short-circuiting portion.

* * * * *